US011846117B2

(12) United States Patent
Ross

(10) Patent No.: US 11,846,117 B2
(45) Date of Patent: Dec. 19, 2023

(54) FLUID CURRENT PRODUCING APPARATUS ASSEMBLY

(71) Applicant: Karl Lewis Ross, Whangaparaoa (NZ)

(72) Inventor: Karl Lewis Ross, Whangaparaoa (NZ)

( * ) Notice: Subject to any disclaimer, the term of this patent is extended or adjusted under 35 U.S.C. 154(b) by 404 days.

(21) Appl. No.: 16/788,971

(22) Filed: Feb. 12, 2020

(65) Prior Publication Data

US 2020/0256074 A1 Aug. 13, 2020

(30) Foreign Application Priority Data

Feb. 12, 2019 (NZ) ..... 750607

(51) Int. Cl.

| | |
|---|---|
| ***A63B 69/12*** | (2006.01) |
| ***E04H 4/00*** | (2006.01) |
| ***A63B 31/00*** | (2006.01) |

(52) U.S. Cl.

CPC ..... *E04H 4/0006* (2013.01); *A63B 31/00* (2013.01); *A63B 69/125* (2013.01)

(58) Field of Classification Search

CPC ..... A63B 69/125; A63B 2225/605; A63B 2225/62; E04H 4/0006; E04H 4/103

See application file for complete search history.

(56) References Cited

U.S. PATENT DOCUMENTS

| | | | |
|---|---|---|---|
| 4,598,904 | A | 7/1986 | Roth |
| 6,168,551 | B1 | 1/2001 | McGuinness |
| 6,322,454 | B1 | 11/2001 | Gordon |
| 2005/0090337 | A1 | 4/2005 | Ross et al. |
| 2007/0207881 | A1 | 9/2007 | Ross et al. |
| 2013/0344972 | A1 | 12/2013 | Hoeschler et al. |

(Continued)

FOREIGN PATENT DOCUMENTS

| | | | |
|---|---|---|---|
| CA | 2190695 | * | 5/1998 |
| CA | 2869343 | A1 | 4/2015 |
| CN | 2179771 | Y | 10/1994 |

(Continued)

*Primary Examiner* — Sunil Singh
(74) *Attorney, Agent, or Firm* — YoungBasileHanlon&MacFarlane, PC

(57) ABSTRACT

A fluid current producing apparatus assembly for use in a body of water includes at least one receptacle 2, current producing apparatus 3 and inflation and deflation apparatus 22*c*. Each receptacle 2 includes a body forming at least one enclosed inside space which further contains at least one independently inflatable and deflatable compartment 19 therein for receipt of a fluid to at least inflate at least a portion of the receptacle. Each receptacle includes a body having an inner surface 17*b*, outer surface 17*a* and at least one internal chamber 19 which is inflated by the inflation and deflation apparatus 22*c* which modifies the outward shape of receptacle 2. When the fluid is forced by current producing apparatus 3 over the outer 17*a* of each receptacle 2 or chamber from a front of the current producing apparatus 3 or away from the current producing apparatus 3, and fluid is drawn in predominantly from around the current producing apparatus 3 and the sides of the at least one receptacle 2 back to the current producing apparatus 3 in a circuit of flow, thereby creating different current or wave patterns for the water flowing over the outer surfaces 17*a* of, inflatable, chamber portions 30, 31. A method is also included.

19 Claims, 22 Drawing Sheets

(56) References Cited

U.S. PATENT DOCUMENTS

| | | | |
|---|---|---|---|
| 2014/0323273 | A1 | 10/2014 | Massola |
| 2015/0057093 | A1 | 2/2015 | Murphy |

FOREIGN PATENT DOCUMENTS

| | | | |
|---|---|---|---|
| CN | 2487415 | Y | 4/2002 |
| CN | 2522121 | Y | 11/2002 |
| CN | 201684386 | U | 12/2010 |
| CN | 201862235 | U | 6/2011 |
| CN | 201930497 | U | 8/2011 |
| CN | 201941962 | U | 8/2011 |
| CN | 102389628 | A | 3/2012 |
| CN | 202342763 | U | 7/2012 |
| CN | 203043491 | U | 7/2013 |
| CN | 104114244 | A | 10/2014 |
| FR | 2640881 | A1 | 6/1990 |
| WO | 2011098690 | A1 | 8/2011 |
| WO | 2015025298 | A1 | 2/2015 |

* cited by examiner

FLUID CURRENT PRODUCING APPARATUS ASSEMBLY

CROSS-REFERENCE TO RELATED APPLICATIONS

This application claims priority to and the benefit of New Zealand Application No. 750607, filed on Feb. 12, 2019, the entire disclosure of which is hereby incorporated by reference.

BACKGROUND

The invention relates to a fluid current producing or simulating apparatus assembly which is suitable for creating certain predictable current pattern formations and to a method of installation/application. The invention is directed particularly but not solely for a water current producing or simulating apparatus assembly for training water users in a pool or enclosed body of water to be able to handle many different current conditions in relative safety and/or the current simulation apparatus can be used as an amusement facility.

BACKGROUND OF INVENTION

Due to a ready access to water at beaches and rivers, New Zealand has a relatively high death rate from drowning compared to other countries. Injury is also another problem with water use which in itself is costly to the country including time off work and various health professionals such as doctors and facilities like hospitals.

Aggressive rip currents like for example at many New Zealand North Island, West Coast beaches are a hazard for swimmers, fishermen and boating. Any activities in or around water carry the risk of injury or drowning. Almost any use adjacent or in water is at risk from unnecessary drowning. To counter this risk, New Zealand has numerous agencies such as water safety council and lifesaving organizations that attempt to reduce the problem by advertising or by being on site. Maintaining such organizations and infrastructure is costly and the country would benefit from water users being better trained to cope with adverse water conditions A problem with existing methods of training people in regard to water safety and swimming, is a lack of opportunity to train in potentially challenging conditions in a safe and secure manner. Desired challenging conditions include needing different water conditions including currents and waves.

Existing wave pools can be used for some training methods but are expensive to alter and are not designed to readily create different water current patterns with not many or potentially none being mobile.

Currently training for challenging situations involves the use of existing outdoor natural areas such as beaches and rivers. However, it is well known that beaches, rivers and lakes though being challenging can cause unnecessary risk to swimmers during training. Use is dependent on a number of factors i.e weather conditions, safety and accessibility.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the invention to provide fluid current producing apparatus assembly and method of installation or operation that ameliorates some of the disadvantages and limitations of the known art or at least provide the public with a useful choice.

SUMMARY OF INVENTION

In a first aspect the invention resides in a fluid current producing apparatus assembly 1 for use in a fluid such as a body of water, the assembly including at least one receptacle 2, and current producing apparatus 3 and inflation and deflation apparatus 22*c*. Each, receptacle 2 includes a body forming at least one enclosed space 19 which further contains at least one independently inflatable and deflatable chamber therein for receipt of a fluid to at inflate a portion of the receptacle 2 therein having an inner surface 17*b* and the body having an outer surface 17*a* being outside the enclosed space 19 which is where controllable inflation and deflation occurs to modify the shape and flow pattern of receptacle 2, and the body of the receptacle 2 having end wall 15, side walls 16, an outer surface 17*a* of a top wall 17 and an outer surface 17*a* of a base wall 18 wherein the receptacle 2 also includes at least one enclosed space 19 is formed of chambers 30, 31 which are constructed to allow inflation or deflation therein by inflation and deflation apparatus 22*c*, wherein the at least one receptacle 2 is fluidly joined or connected to current producing apparatus 3 such that the current producing apparatus 3 is configured to operate by drawing in a portion of fluid from the surrounding body of fluid surrounding the fluid current producing assembly and pushes or forces a first subportion of fluid back over the outer surface 17*a* of the at least one inflated receptacle 2 in a direction away from the current producing apparatus 3 in a circuit;

wherein inflation by the inflation and deflation apparatus 22*c*, of the at least one chamber 30, 31 by a second subportion of fluid drawn into at least a part of chamber 30, 31 of at least one receptacle 2 forces at least an outside part or portions of the at least one receptacle 2 to be inflated—as an inflated chamber and formed of a particular outward upper shape thereby when the first subportion of fluid is forced by current producing apparatus 3 over the outer surface 17*a* of each receptacle 2 from in front of the current producing apparatus 3 or away from the current producing apparatus 3, whereby the portion of fluid is drawn in predominantly from the surrounding fluid of the current producing apparatus 3 and extra fluid is drawn in from first the side walls 16 via first aperture 21 and then through at least one first passageway 20 back towards the current producing apparatus 3 in a circuit of flow, thereby creating different current or wave patterns for the fluid flowing over the outer surfaces 17*a* of the inflated chambers 30, 31.

Preferably each receptacle 2 includes the at least one first passageway 20 extending from end wall 15 to end wall 15 which is connected to the first aperture 21 where first aperture 21 connects to first passageway 20 located on side walls 16 this is an extra facility to allow fluid to be pulled away from the side walls 16 to at least reduce eddy currents forming on side walls 16 of receptacle 2, wherein there is no inflation and deflation in this first passageway 20 and only minor flow will be induced in and through first passageway 20 as compared to the flow outside the sides 9 of the fluid current producing apparatus assembly 1 and back to current producing apparatus 3.

Preferably, each body of receptacle 2 includes a closable inlet and outlet system which is formed of at least one second aperture 22 to allow constant inflation or deflation of at least each enclosed space 19 or chamber 30, 31 via the inflation and deflation apparatus 22*c* with the fluid being any suitable flowable material such as water which will change the pattern of flow of fluid over the outer surface 17*a* of at least top wall 17 of each receptacle 2.

Preferably, each receptacle 2 includes a bag connecting system in the form of in this example of one part of a zip fastening system located at an edge between the top wall 17 and end wall 15, and at least one cover flap to cover the zip fastening system whereby each adjoining receptacle 2 includes part of the zip fastening system to work together to fasten one receptacle 2 to another adjoining receptacle 2 whereby each receptacle 2 includes track and one of each receptacle includes a slider so that when two receptacles 2 are abutting or adjoining so that they can be zipped together to form a continuous channel wherein the first aperture 21 accessing first passageway 20 are located in side walls 16 to insure little or no eddy currents will form on side walls 16.

Preferably, each receptacle 2 is fabricated from a malleable or flexible type of product that is able to allow pressurizing by means of fluid which cause at least a portion of the receptacle 2 to be inflated or de-inflated wherein the fluid is water.

Preferably, each receptacle 2 has at least one middle chamber 30 and at least two outer chambers 31 which are interconnected to allow inflation or deflation there through and therein which are fluidly separated from each other each having at least one enclosed space 19 or chambers 30, 31 therein.

Preferably, when inflated, the top wall 17 of the middle chamber 30 and outer chamber 31 are shaped to cause different current or wave patterns there over at least the outer surface 17*a* of the top wall 17 wherein the shape of the middle chamber 30 significantly affects the wave pattern.

Preferably, the second enclosed space 19 of the receptacle 2 includes a first outer shape (see FIGS. 2, 4, 5, 6, 9) which can be termed a rip current mode wherein the receptacle 2 includes a planar uninflated middle chamber 30 between two inflated outer chamber 31 being block shaped with inner sloped outer surfaces 17*a*.

Preferably or alternatively, at least one receptacle 2 includes a second shape (see FIG. 7*a*) which can be termed a wake board mode which includes a middle chamber 30 when fully inflated having an outer surface 17*a* level with a top wall 17 of the outer chamber 31 wherein the outer surface 17*a* is level across the outer chamber 31 and middle chamber 30.

Preferably, each receptacle 2 includes a third middle shape (see FIGS. 1, 3, 7*b* and 8) which can be termed a rapids mode which includes a middle chamber 30 when inflated is of a block shape larger than a non-inflated planar portion of the rip current mode but less in height than an inflated height of the outer chamber 31, with the outer chamber 31 having an inner sloped top surface, wherein a middle region has a level top surface 17*a*, less in height than level top surfaces of the outer portions which are ramped portions 33 there between.

Preferably each receptacle 2 includes a fourth middle shape (see FIG. 16) which is also termed a wake board mode which when inflated includes at least a peaked inflated middle chamber 30 between outer level portions wherein there are ramped portions 33 for the outer chamber 31 meeting the middle chamber 30 and the middle chamber 30 is curved ramped to define a central peak 56.

Preferably, the current producing apparatus 3 includes a housing with at least one pump 41 and meshed guarded intake piping 43 wherein the piping fluidly interconnects the current producing apparatus 3 to the first passageway 20 of at least one receptacle 2 to enable the pump 41 to draw in fluid, which is then forced or pumped out, over the top wall 17 of the receptacle.

Preferably, a power supply is operatively connected to the pump 41 or pumping system and inflation and deflation apparatus 22*c*.

Preferably, the receptacle 2 includes rounded corners between side walls 16 and top wall 17 and between any changes in slope of the surface of the top wall 17 of the receptacles.

Preferably several receptacles 2 form an inflatable and/or de-flation bag system which are individually inflated and deflated via the inlet and outlet associated with second aperture 22 and connect by a piping system 22*a* to at least one enclosed space 19 or chamber 30, 31 for at least a portion of the at least one receptacle 2 wherein the piping system 22*a* includes interconnected pipework 22*b*, and inflation and deflation apparatus 22*c*.

Preferably several receptacles 2 are fluidly interconnected by the piping system 22*a* that will be attached to the inlet and outlet associated with second aperture 22 of each receptacle 2 to at least one enclosed space 19 or chamber 30, 31 and to an inflation and deflation apparatus 22*c* whereby each individual receptacle 2 is inflated and deflated by pumping fluid such as fluid on demand.

Preferably a pumping sequence is utilized in regards to the inflation and deflation of individual enclosed space 19 or chamber(s) 30, 31 of the receptacle 2 to be controlled by the inflation and deflation apparatus 22*c* which are controlled by a computer program that will simulate potential multiple current types.

Preferably the inflation and deflation apparatus 22*c* includes at least one pump, electronic controlled solenoid, pump and piping system 22*a* being operatively connected to the second entry apertures 22 having an inlet and outlet valve system of the side walls 16 of receptacle 2.

In a second aspect, the invention resides in a fluid current producing apparatus assembly for a body of water wherein each receptacle 2 consist of the minimum following items

- 3× individual chambers 30, 31
- 1× middle chamber 30 (individual enclosed space 19)
- 2× outer chamber 31 (individual enclosed space 19)
- 3× sets of inlet and outlet valve system 22
- 2× passageway e.g. pipe 20
- 2× side inlet of first aperture 21 to passageway 20
- Multiple extra enclosed chamber 30, 31 on top of middle chamber portion 30 is what recreates multiple extra current patterns, such as river and wake mode.

In a second aspect the invention resides in a method of assembly of a fluid current producing or simulating apparatus assembly in a body of water, the fluid current producing or simulating apparatus assembly includes at least one receptacle 2 that is to be inflated having a middle chamber 30 between side or outer chambers 31 having at least one inflatable chamber 30, 31 therein, to be fluidly joined or connected to a current producing apparatus 3 and inflation and deflation apparatus 22*c*, such that the current producing apparatus 3 draws fluid from around the current producing apparatus 3 and through the first passageway 20 and first aperture 21 of receptacles 2 and to then force the fluid over the outside of the middle chamber 30 and top half of the outer chamber 31 of the receptacle 2 being inflated by inflation and deflation apparatus 22*c* and back around through receptacle 2 in a continuous circuit with few vortices, wherein the assembly of the apparatus includes the following steps:

a) Providing a body of fluid such as water;
b) Delivering current producing apparatus 3 and a number of receptacles 2 to site;
c) Placing receptacles 2 in abutting and floating relationship in the body of fluid such as a pool to form an area with sides 9 and ends 7;
d) Placing current producing apparatus 3 in position at one end 7 of the area abutting a first receptacle 2;
e) Connecting the first receptacle 2 to the current producing apparatus 3 using zip connection;
f) Connecting additional receptacles 2 to each other with zip connections and cover with cover flap such that the receptacles 2 are fluidly interconnected;
g) Connecting the inflation and deflation apparatus 22*c* to a power source connect pressure piping such as pipework 22*b* (see FIG. 14) or by any other suitable means to second entry aperture 22;
h) Inflating each receptacle 2 with fluid (through second entry aperture 22) to form the desired bag shape forming an outer shape for top 17 for a particular current simulation setting such that the first passageway 20 is interconnected whereby the interconnected receptacles 2 then drop to the bottom of the pool;
i) Turning the current producing apparatus 3 on in order to draw in fluid from behind and from the sides of the current producing apparatus 3 (i.e. piping installed into side walls 16 of each receptacle 2) in through an entry region of first aperture 21 to travel up the first passageway 20 and/or from behind the current producing apparatus 3;
j) Fluid is then forced out a front of a housing of the current producing apparatus 3 to go over the top wall surfaces of the middle chamber 30 and the top wall of the outer chambers 31 of the fluidly connected receptacles 2.

BRIEF DESCRIPTION OF THE DRAWINGS

The invention will now be described, by way of example only, by reference to the accompanying drawings.

DETAILED DESCRIPTION

Figure 1:
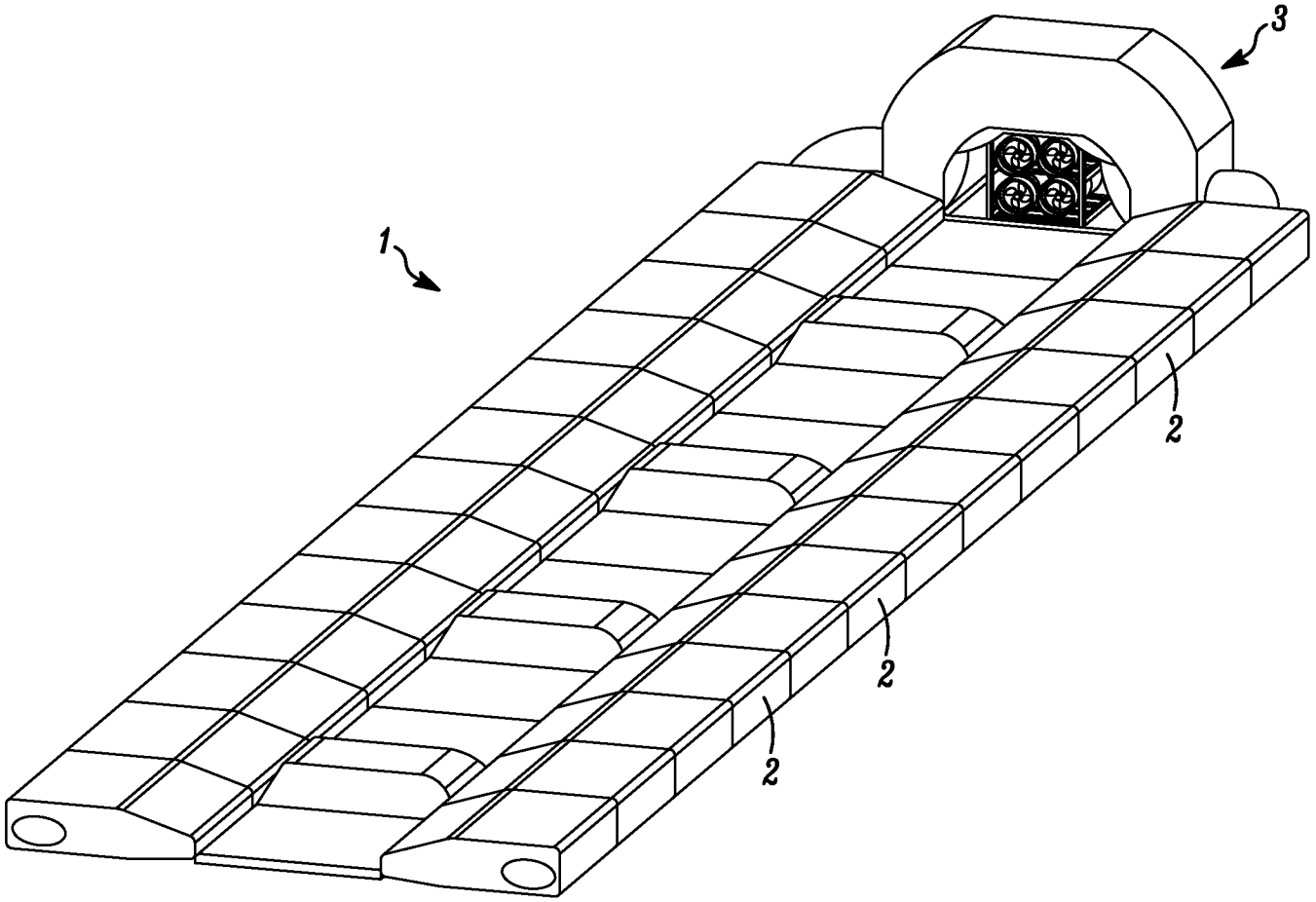
FIG. 1 is an upper perspective view of a fluid current producing or simulating apparatus assembly 1 in accordance with a first preferred embodiment of the invention showing a series of fluidly interconnected inflatable receptacles 2 and current producing apparatus 3 (also seen in FIGS. 3 and 7*b*). Alternating inflated central or middle chambers of the receptacles are raised beyond others to provide for a rapids mode.

The following description will describe the invention in relation to preferred embodiments of the invention, namely a fluid current producing or simulation/simulating apparatus assembly. The invention is in no way limited to these preferred embodiments as they are purely to exemplify the invention only and that possible variations and modifications would be readily apparent without departing from the scope of the invention.

FIGS. 1-25 show fluid current producing or simulation/simulating apparatus assembly 1 which includes at least one receptacle 2 which in this example is an inflatable receptacle 2 and at least one current producing apparatus 3. The at least one receptacle 2 can be formed as several receptacles 2 which are fluidly interconnected fluidly in part and also separately to form a volume space with an area having a length dimension 5, a width dimension 6, ends 7, 8, sides 9 and depth 10, to be located on a floor or base of a body of fluid e.g. water such as a pool (not shown) to form an inflatable/deflatable fluid flow receptacle or bag system.

At least one current producing apparatus 3, which is configured or constructed to be able to operate with a suitable fluid such as water to be able to receive or drawing in that fluid and then push the fluid in a defined direction, is located at one end such as end 7 of the area which serves to define the current direction over the inflatable receptacle 2. The current direction of the fluid, such as for example water, is oriented parallel with the sides 9 of the area of several receptacles 2, in at least semi-enclosed area or body of water.

In general the current producing or simulating apparatus assembly 1 is designed to have a participant experience of the flow (see arrows FF—forced flow and DF—drawn flow in figures representing the direction of flow of the fluid e.g., water) of a moving body of fluid in different modes by installing fluidly connected receptacles 2 on the floor of a body of fluid and forcing fluid over, around and through them in an almost continuous circuit, with optionally few or no vortices created. The modes in the form of outward shapes of the receptacles 2 can be used for any type of use, such as for example training, safety, and/or recreational purposes. The arrows DF and FF show some or most of the main or predominate flow directions but not all returning to the current producing apparatus 3 and the size of the arrows is meant to represent the proportion of the flow with respect to each other.

Methods can be used to hold the receptacles 2 down under a fluid e.g. water, such as vacuuming it down with suction pads to the pool floor, or holding it down with water bags located above the surface of the water and that sit on top of stilts that run down to the submerged receptacle system and connected under the water.

The modes or outward shapes are produced by inflating the receptacles 2, which include an enclosed space 19 which are formed as chambers 30, 31 of the receptacles 2, vary differently across each receptacle 2 and/or in different inflation levels from one end of the pool to the other. The inflating process can include initial air inflation to enable the positioning of the fluid current producing or simulating apparatus assembly 1 in the pool of water and then purging the air by filling with water to sink the fluid current producing or simulating apparatus assembly 1 into position relative to the floor of the pool or bed of the body of water. Each receptacle 2 has middle chamber 30 and outer chamber 31 that can also be referred to as portions, each with its own at least one second aperture 22 which includes an inlet and outlet structure leading to enclosed spaces 19 or chambers 30, 31 which are fluidly separate to a first passageway 20, e.g. a pipe.

Figure 6:
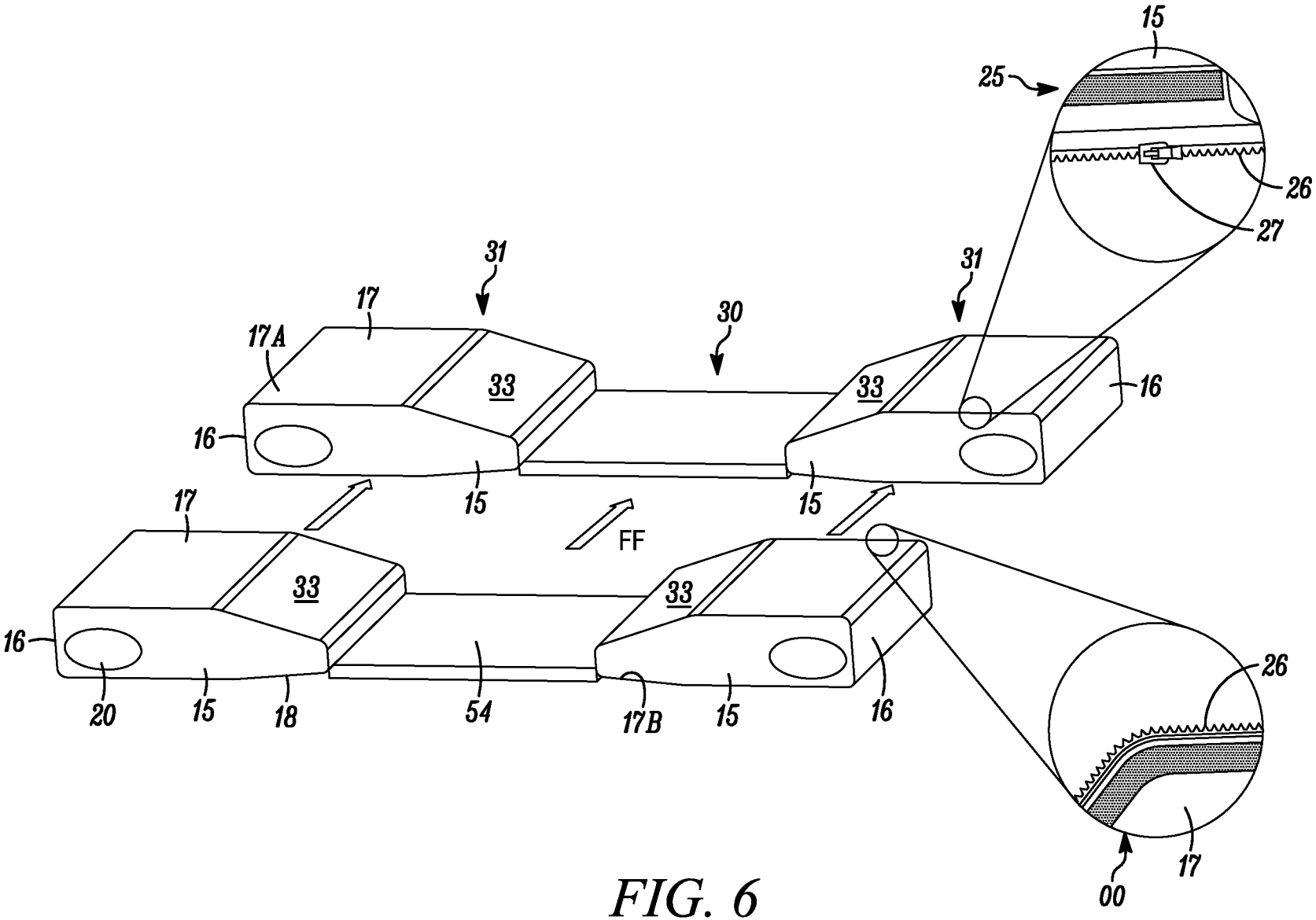
FIG. 6 is a perspective view of two abutting receptacles 2 having a first shape (see also FIG. 2). This is a rip current mode as per FIGS. 2, 4 and 5.
Figure 7A:
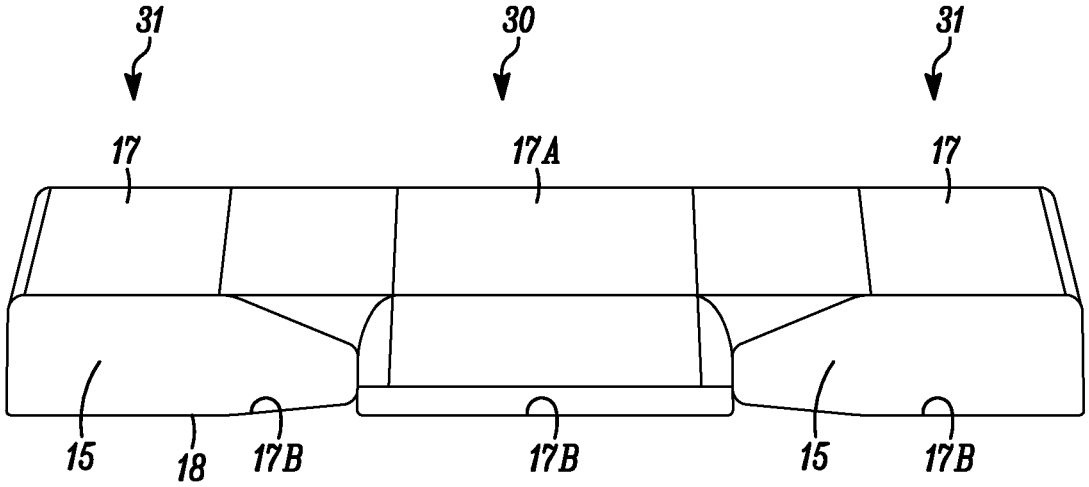
FIG. 7*a* is a perspective view of further receptacle 2 having a second shape. The receptacle 2 middle chamber are fully inflated for a wake board mode.
Figure 16:
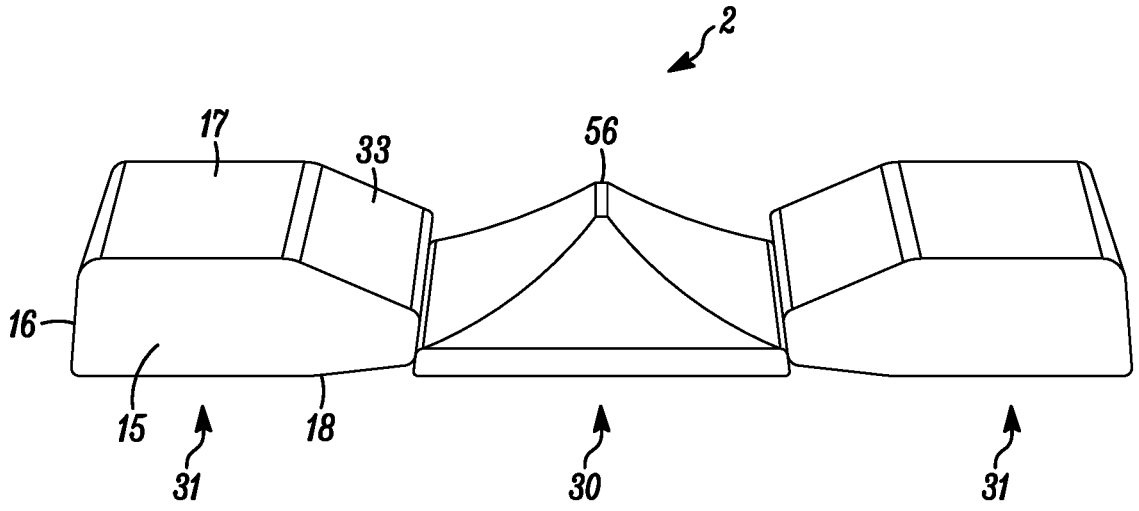
FIG. 16 is close up schematic upper perspective view of one receptacle from the assembly of FIG. 15.
Figure 17:
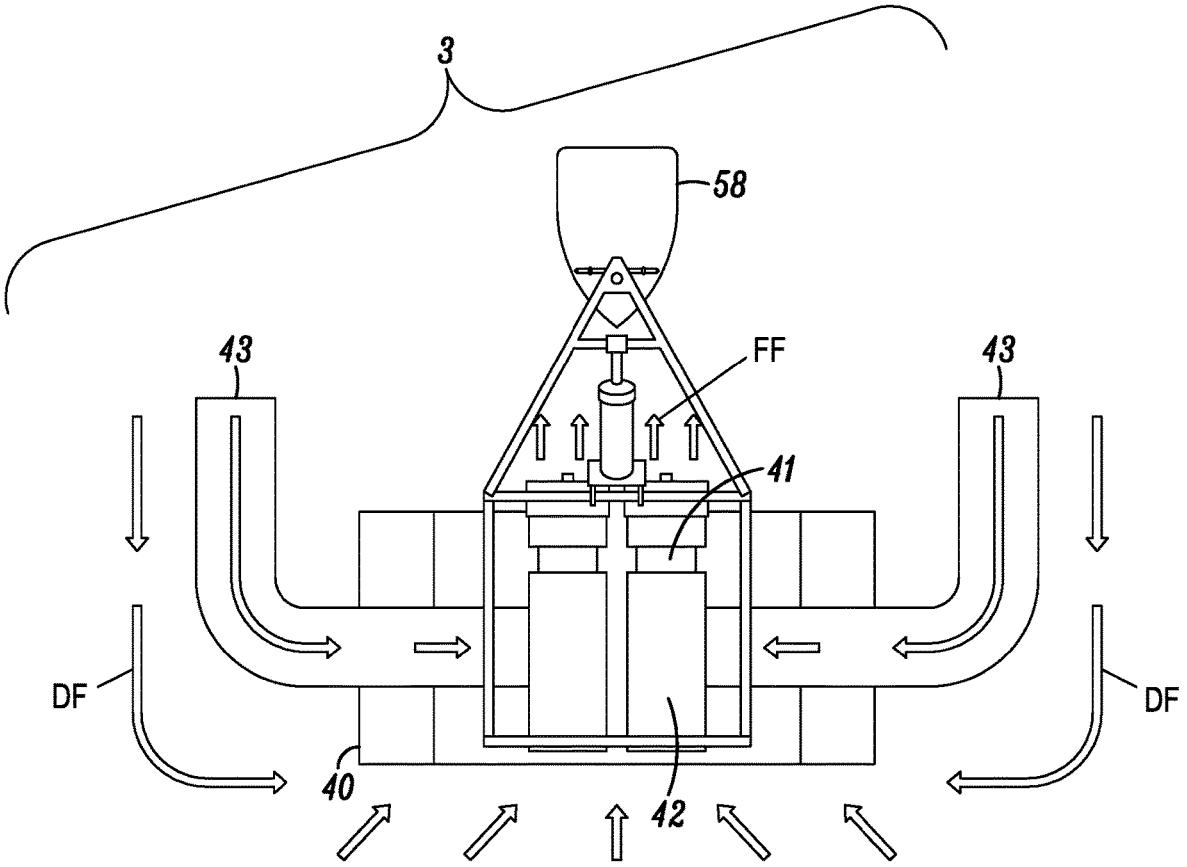
FIG. 17 is a schematic top plan view of the current producing apparatus 3 of FIG. 15 showing wake producing components such as shroud 58.
Figure 18:
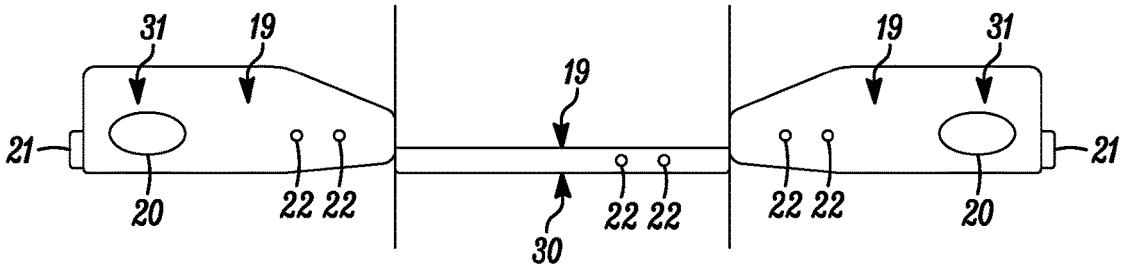
FIG. 18 is a schematic cross-sectional view of one receptacle having a middle chamber 30 between outer chamber 31, first aperture 21 to first passageway 20 and inlet and outlet valve system of second apertures 22 to enclosed space 19 for each chamber 30 and 31.

Some current-producing or current simulation/simulating examples can be a rapids mode as seen in FIGS. 1, 3, 7*b*, 8 which can also be called a river rapids mode, a rip current mode (see FIGS. 2, 4, 5, 6, 9) where the participant is required to wade into the flow in a number of marked positions down the current flow and, a wake board mode as seen in FIG. 7*a* where there is full inflation of the receptacles 2 along with the first set of receptacles creating a specific shape in the center in order to force the water upwards towards the wake press 54. See also another version of receptacle shape for a wake board mode as seen in FIG. 16.

If the assembly as disclosed herein is used for recreational use, the setup will require the wake ramp receptacle 2 to be installed along the first number of receptacles which is connected to the current producing apparatus 3 and the wake press 54 needs to be bolted to a frame of the current producing apparatus 3.

The wake press 54 is a predesigned shape that is designed to be efficient in creating and forming wake wave patterns, The fluid such as water is forced via the current producing apparatus 3 under the wake press 54 and may then be forced upwards by the middle chamber wake ramp thus creating a specific wave formation. The wake press 54 is controllable meaning up down and left and right, with the up down method creating a larger and smaller wave configuration and the left and right method steering the wave.

The wake ramp also can steer the wave via inflation and deflation. Please note all controlling of the wake press 54 is done via a either an electric or hydraulic system which controls varying ram configurations.

The use of the fluid current producing or simulating apparatus assembly 1 and its various modes or receptacle shapes, can assist in demonstrating authentically the intensity and strength of the water at different water heights and also to demonstrate a mild, controlled, real world sensation. From there we can create a scaffold learning experience in order for the participant to develop a mental and physical response of staying calm, staying afloat and to not swim against the current.

The receptacles 2 of the present invention are made or fabricated out of any suitable malleable or flexible type of material or combination of materials such as for example hypalon or PVC vinyl e.g. a bag or an inflatable bag which are constructed to allow flow down and over an outside or outer surface 17*a* of a middle chamber of receptacle 2 away from a current producing apparatus 3 with a return flow mostly passing back around combined side walls 16 of receptacle 2 and some flow being drawn through a first passageway 20 of each receptacle 2 and through side port inlets of at least one first aperture 21 (which can be an entry or exit aperture to first passageway 20 e.g. a pipe in a circuit back towards current producing apparatus 3, and separately be able to have a least a portion of each receptacle 2 to be inflated, de-inflated pressurised therein by the fluid, via a separate at least one chamber 30, 31 of the receptacle(s)), to produce the certain outward shapes for the outward flow of the rest of the fluid in a circuit to travel over the outer surface 17*a* of the chambers 30, 31 to be influenced to produce a certain wave or pattern as desired. Side wall 16 has at least one inlet or port (e.g. with a flap) being the first aperture 21 fluidly leading to and connected to first passageway 20 to remove or at least reduce eddy currents from side walls 16 so that no or very little eddy currents will form near or on the sides of receptacle 2.

This first aperture 21 is an extra facility to allow water to be pulled away and drawn in from outside of the side walls 16 to stop eddy currents forming on the side walls 16 of the receptacle 2 whereby there is no inflation and deflation in this first aperture to first passageway 20.

Receptacles 2 and Inflatable Receptacle System

As seen in FIGS. 1-9 each receptacle 2 (for example an inflatable/deflatable bag) includes a body which in this example is an elongate volume defining end walls 15, side walls 16, top wall 17 and base wall 18, outer surface 17*a* and inner surface 17*b* enclosing a second enclosed space 19 or chamber 30, 31 and first passageway 20 therein. The receptacles 2 are fabricated from a material able to be inflated and or deflated with a fluid like, for example, air and/or water and be able to be used in combination, in a pool or body of water in a building or in the open environment.

Once the fluid current producing or simulating apparatus assembly 1 is placed in a body of water, each receptacle 2 has at least one open first passageway 20 extending from end wall 15 to end wall 15 fluidly connected to an entry region of a first aperture 21. An inlet and outlet valve or port system located on at least the side walls 16 and in one example can be an entry or outlet aperture and receptacle joining or fastening system in the form of for example, a zipper or similar device for the receptacle connecting system 25 which together function to allow the fluid flow as forced by the current producing apparatus 3, to pass the fluid over the top wall of the at least one receptacle 2 away from the current producing apparatus 3 and be drawn back around along sides 9 of the fluid current producing or simulating apparatus assembly 1 with small flow through first passageway 20 and side inlets of first apertures 21 of side walls 16 from a distal end of the first passageway 20 from the current producing apparatus 3 back to the current producing apparatus 3 or vice versa, in a continuous circuit.

Figure 14:
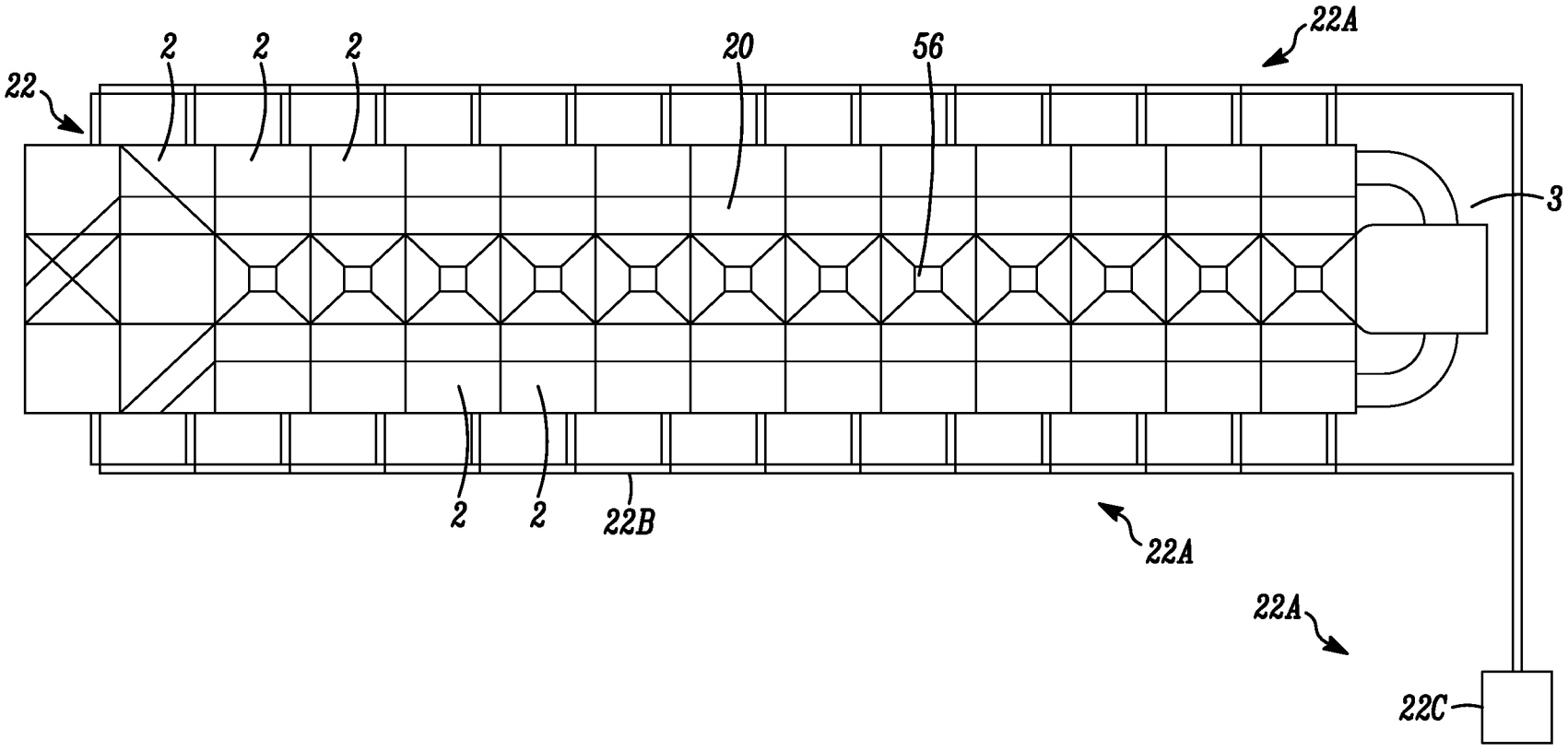
FIG. 14 is a plan view of the inflammation and deflation apparatus 22*c* similar to FIGS. 4 and 5, with extra pipework for inflation and deflation of the receptacles 2 and chambers 30, and 31 via inlet and outlet associated with aperture 22.

Each second aperture 22 includes a valve system for entry to enclosed space 19 or chamber 30, 31 i.e. are not fluidly connected to the first passageway 20 and its first apertures 21. The inlet and outlet system of second aperture 22 includes a valved system for an inlet or outlet having a port and valve, connectable to piping as shown in FIG. 14.

Furthermore, as shown in FIGS. 6-9 the shape of the receptacle 2 can vary depending on the types of current patterns or shapes required which is governed by the inflated shape of outer surface 17*a* of top wall 17 using the chambers 30, 31 to inflate each enclosed space 19 as required. First passageway 20 in this example can be considered to be an open pipe which is designed to be optionally aiding in eliminating or reducing eddy currents on sides 9 of the fluid current producing or simulating apparatus assembly 1 on the return flow back to the current producing apparatus 3. The middle chamber 30 is shaped to mostly provide the main effect on the desired wave pattern required.

At least one entry region of first aperture 21 is fluidly connected via a first entry which leads to first passageway 20 which is designed to provide an entry for fluid to then pass into first passageway 20. In this example, entry region of first aperture 21 and its entry to first passageway 20 can be shaped to be smaller in diameter or volume than first passageway 20 for a small amount of return flow back to the current producing apparatus 3.

Each second entry aperture 22 can include this example of an entry aperture of the inlet and outlet valve system which is for separate access from an optional first passageway 20, to enclosed space 19 which is in the form of at least one individually enclosed space 19 or chamber 30, 31 of all receptacles 2, which is fillable or pressurized with any suitable fluid such as for example water and also air to form a specific outward shape for various modes of use. The inlet and outlet valve system of the second aperture 22 is in this example an entry aperture which also includes a re-sealable valve member—not shown. Top or outer surface 17*a* varies in shape by having angled walls whereas the outer surface of the base wall 18 can be relatively flat and end walls 15 are substantially planar vertical walls.

The second apertures 22 includes in this example entry apertures for the inlet and outlet valve system of each receptacle 2 and includes a valve body assembly, an inflation and deflation apparatus 22*c* which includes a valve body assembly with its own inflation and deflation pumping system, electronic controlled solenoid and a piping system 22*a* (e.g. pressure piping of any kind) as shown in FIG. 14, which includes interconnected pipework 22*b* and inflation and deflation apparatus 22*c* as shown in FIG. 14 to allow for the pumping of a fluid i.e. water and or air. This inlet and outlet valve system can be computer controlled. The piping system 22*a* that will be attached to the receptacle 2 which shows the flow and return of the pipework 22*b* on both sides of each receptacle 2 which run back to the inflation and deflation apparatus 22*c* which will be computer controlled allowing individual receptacles 2 to be inflated and deflated on demand. The inflation and deflation apparatus 22*c* is operatively connected to the second aperture 22 located on side walls 16 on each enclosed space 19 or chamber 30, 31.

The inflation and deflation apparatus 22*c* consists of a pressure producing pump that fills the inlet pipework to each enclosed space 19 or chamber 30, 31 along with a vacuum suction pump that vacuums or sucks the water from the outlet pipework and chamber adjoining. The inlets and outlets are controlled via computer modulation and are connected but not limited to a electronic solenoid bank. This allows for inflation and deflation to each enclosed space 19 or chamber 30, 31 systematically. Every enclosed space 19 or chamber 30, 31 will be numbered and referenced back to the digital control matrix.

After pumping some air into the receptacles 2, enclosed space 19 or chambers 30, 31, the receptacles 2 having chambers, enclosed spaces 19 or chambers 30, 31 are able to be positioned at a suitable location, whereby water is then pumped into the enclosed space 19 or chambers 30, 31 to allow the complete fluid current producing or simulating apparatus assembly 1 to be able to be lowered and positioned anywhere from the floor or bed of a body of water to the surface, to some defined position in between.

A receptacle connecting system 25 as shown in FIG. 6, located on an edge between the top wall 17 and end walls 15, includes any means that enables adjoining receptacles 2 being end wall abutting, to be removably joined or connected together to form a fluid connection between the first passageways 20. FIG. 6 shows one example of how the inflatable receptacles 2 are connected or fastened (removably) together which can be but is not limited to a zip fastening system. Each zip fastening system is made up of two side tracks 26 with each side track 26 having a mesh like pattern, a slider 27 and an optional cover flap. By pulling the slider 27 each side track 26 is pulled into the slider 27 to be intermeshed with the other. Cover flap—is unfolded to cover the slider 27 and side tracks 26 to improve water flow there over e.g. reduce friction and/or flow disturbance.

Each receptacle 2 in this example, can include at least one distinct volume or chamber of different shapes in one plane or in several planes on top of each other. For example there can be a middle chamber 30 which is separate and consists of enclosed space 19 within which is between two outer chambers 31 each having an enclosed space 19 within which is separate and consists of enclosed space 19 being a mirror image of each other which can be inflated and deflated according to different or similar shapes and pressures but which each chamber is are separate to each other. The middle chamber 30 can be smaller, larger or the same or different in volume than the two outer chambers 31. The two outer chambers 31 can be of similar shape or not. The three distinct chambers enable each inflatable receptacle 2 to be inflated similarly and/or differently from one another and in each inflatable receptacle 2 such as the middle chamber 30 can be inflated separately to form for example the rapids mode (FIGS. 1, 3,7*b*, 8), rip current mode (FIGS. 2, 4, 5, 6, 9) and wake board mode (FIG. 7*a*).

There is no limit to the number, shape and configuration of enclosed spaces 19 or chambers 30, 31 in receptacles 2 to achieve different current or wave patterns. Furthermore, shapes and extent of curves, ramps, rounded edges, length of slopes, levels angles flat level areas etc of any shape features is not limited in any way.

As shown in the example FIGS. 1, 3, 7*b*, 8 in the rapids shape mode, the middle chamber 30 of the receptacle 2 can be inflated to a level less than the inflation for the outer chambers 31 and can be alternated with inflatable receptacles 2 of the rip current mode to cause the rapids to be produced.

As shown in the example FIGS. 2, 4, 5, 6 and 9 (rip current shape mode) the receptacle 2 includes a planar middle chamber 30 and symmetrical outer chambers 31 having a block shape with inner ramped portions 33. The depth 34 of the middle chamber 30 being much less than the depth of the outer chambers. The middle chamber 30 is not inflated in this mode but the outer chambers 31 are fully inflated.

Figure 7B:
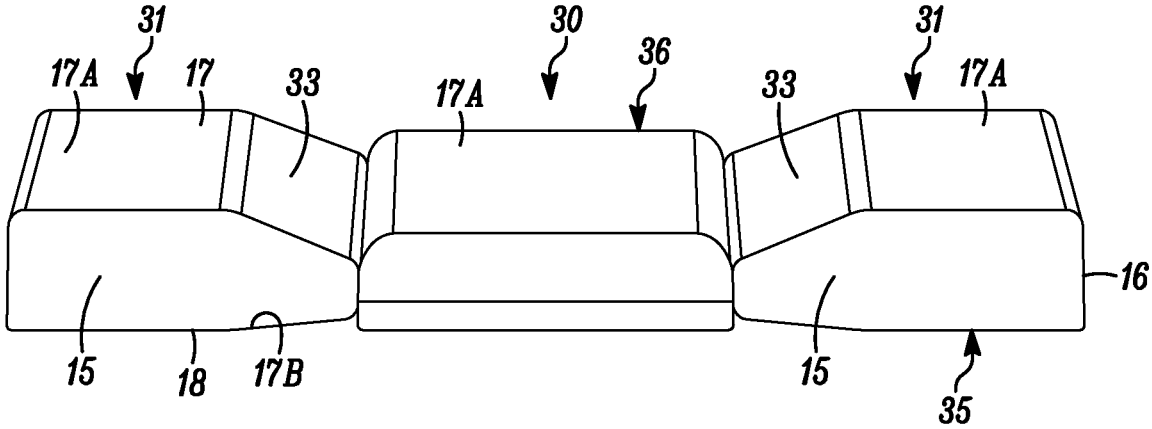
FIG. 7*b* is a perspective view of further receptacle 2 having a third shape (see also FIGS. 1 and 3). This shows the middle chamber as being partially inflated in the rapids or river mode

As shown in FIG. 7*a* (wake board shape mode) shows a similar inflated shape to FIG. 6 but with the middle chamber 30 being level with the outer chambers 31 whereas FIG. 7*b* (rapids mode) shows a flat block like portion in the middle of less inflated depth 36 than the inflation depth 35 of the outer chambers 31 but deeper than the middle chamber of FIG. 6 (which was not inflated) with the outer chambers 31 which are flat blocks with inner ramp portions 33.

Figure 8:
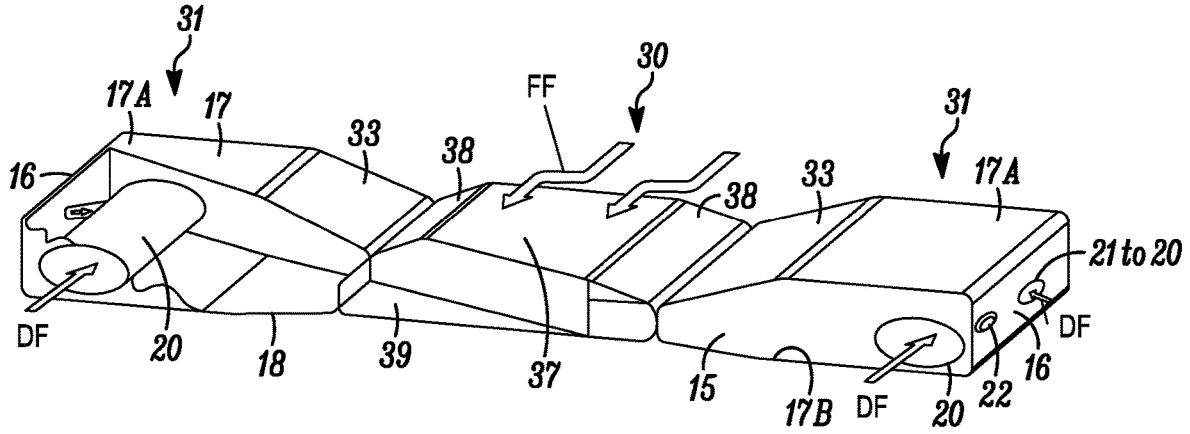
FIG. 8 is a perspective view of a receptacle 2 (FIGS. 1, 3, 7*b*, 8) showing in a cut-out portion the internal shape of the enclosed space 19, with current directions shown on top with smaller return flow currents inside passageway 20 (e.g. a pipe) and entering first aperture 21. This is a rapid/river mode that also shows the enclosed space 19 with cut-outs showing the internal structure.

As shown in FIG. 8 (rapids mode) shows the inflatable receptacle 2 this time having outer chambers 31 similar to the outer chambers 31 of the other figures and the middle chamber 30 inflated to the height of chamber 31 and asymmetrically oriented with downward sloping entrance and exit portions 38, but with an angled cut-out portions showing the inside of one of the outer chambers 31 and middle chamber 30.

Figure 9:
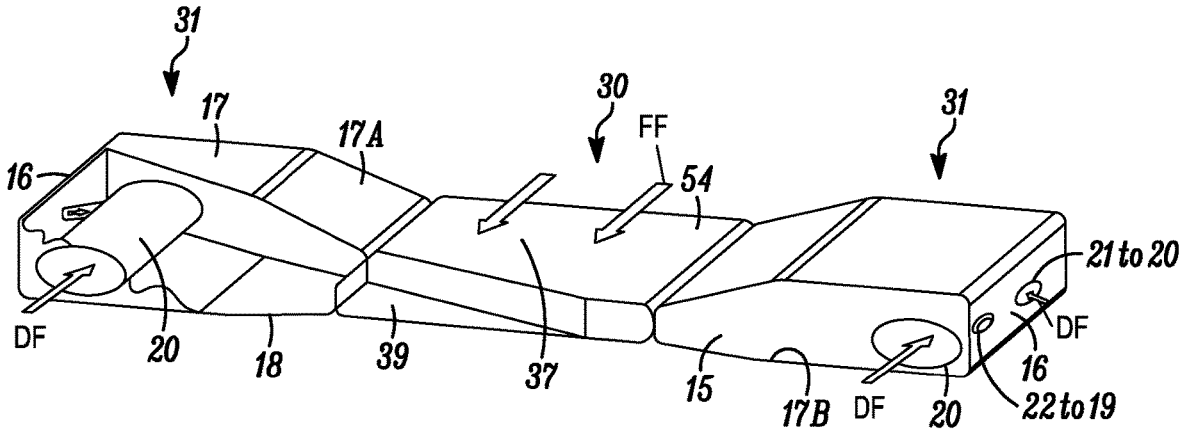
FIG. 9 is a perspective view of an inflatable receptacle showing in a cut-out portion the internal shape, with current directions shown on top and within (see also FIGS. 2, 4, 5, 6 and 9). This is a rip current mode.
Figure 10:
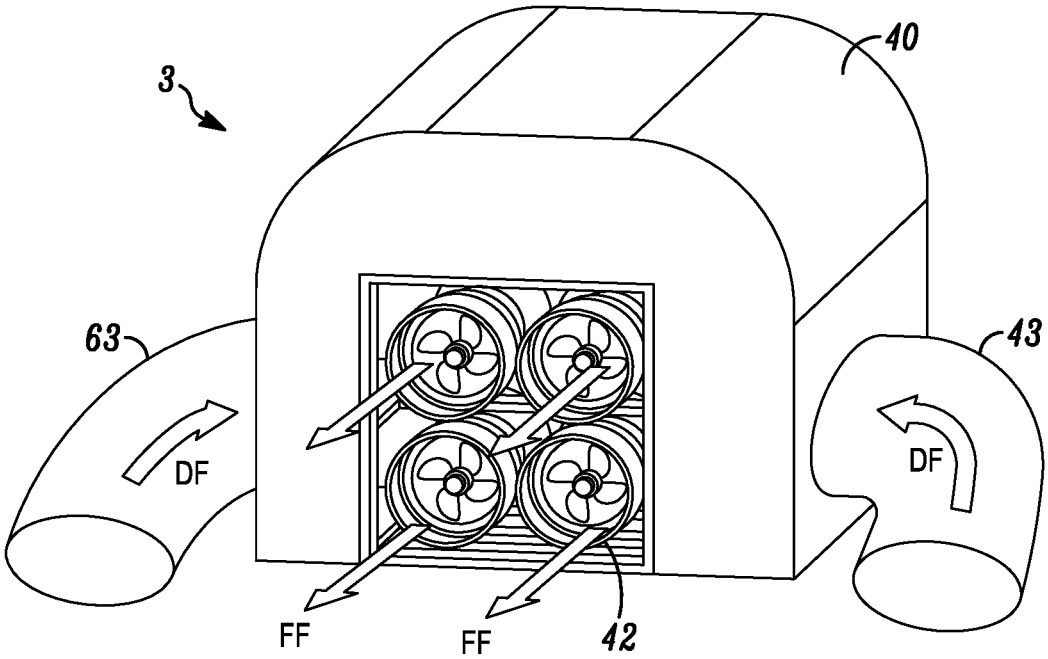
FIG. 10 is a front perspective view of the current producing apparatus.
Figure 11:
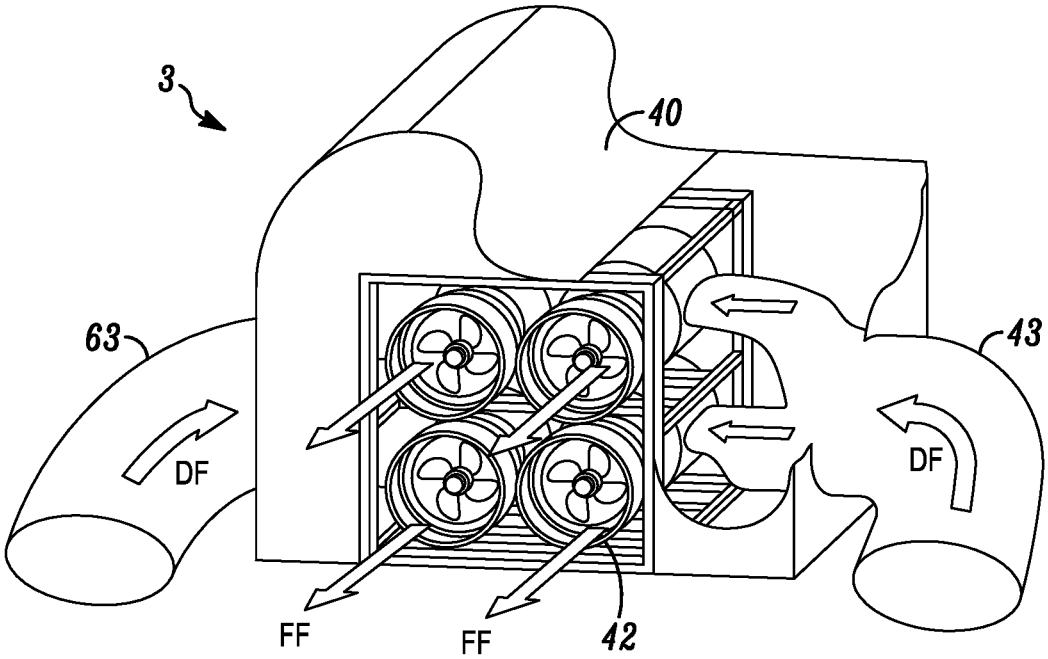
FIG. 11 is a front perspective view with a partial cut-away, of the current producing apparatus with current directions shown.
Figure 12:
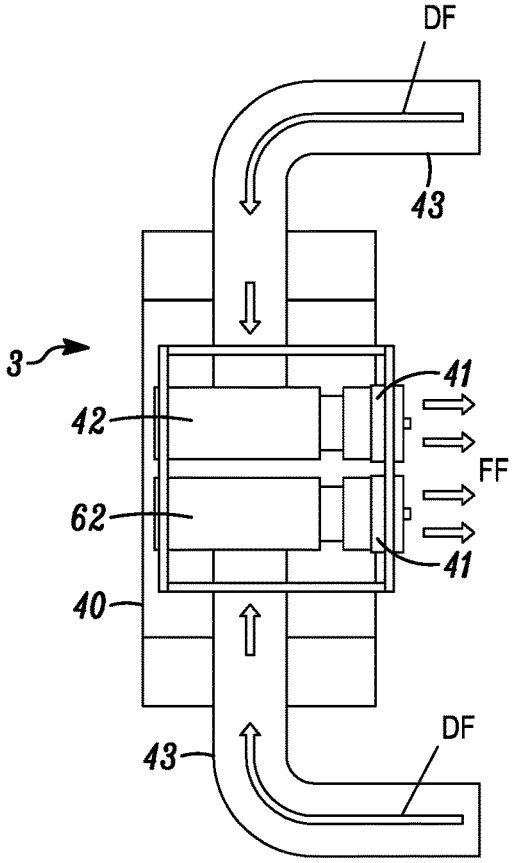
FIG. 12 is a top plan cross sectional view of the current producing apparatus with current directions shown for the first passageway 20.

FIG. 9 (rip current mode) shows yet another aspect of the receptacle 2 with an angled cut away portion shown merely to allow one to see within the receptacle 2.

Current Producing Apparatus 3

The current producing apparatus 3 includes a housing 40, at least one pump 41 and piping 43 (e.g. meshed) with the front being defined as facing the receptacles 2. As seen in the examples of FIGS. 1-3 and 11-12, piping 43 fluidly interconnects at least one pump 41 to an end of the area to first passageway 20 of one side of one abutting receptacle 2. First passageway 20 e.g. pipe needs to be long enough and in one option flexible enough to allow fluid connection to a first receptacle 2 when the inflatable receptacle 2 are initially floating which can be some distance from the current producing apparatus 3 whereas after inflation, the receptacle 2 will be located on the bottom of the pool being possibly closer to the current producing apparatus 3.

As shown in this example there can be at least one pump 41 or pumping system located at the back of the housing 40 functioning to draw water in from around the current producing apparatus 3 and suck water in from each end of the fluidly interconnected receptacles 2 via the main interconnected first passageways 20 e.g. pipes. The pumps 41 then deliver or push the water via the volume surrounding the submerged current producing apparatus 3 and piping 43 (e.g. meshed) and then to the front of the housing 40 and over the receptacle 2 from one end to the distal end and back again in circulation cycle.

As shown in FIG. 14 several receptacles 2 are fluidly externally interconnected by the piping system 22*a* that will be attached to second apertures 22 which includes the entry and exit means of the inlet and outlet valve system and to the inflation and deflation apparatus 22*c* through the form of at least one enclosed space 19 or chamber 30, 31 whereby individual receptacles 2 are inflated and deflated by the inflation and deflation apparatus 22*c* on demand to produce different outward receptacle 2 shapes to form different modes of use via inflation of the enclosed space 19 or chambers 30, 31 to form different current or wave patterns of the water there over and therein in a circuit. A pumping sequence is utilized in regards to the inflation and deflation of individual chambers of the receptacles 2 to be controlled by a pump including inflation and deflation apparatus 22*c* which will be controlled by a computer program that will simulate potential multiple current types.

Figure 13:
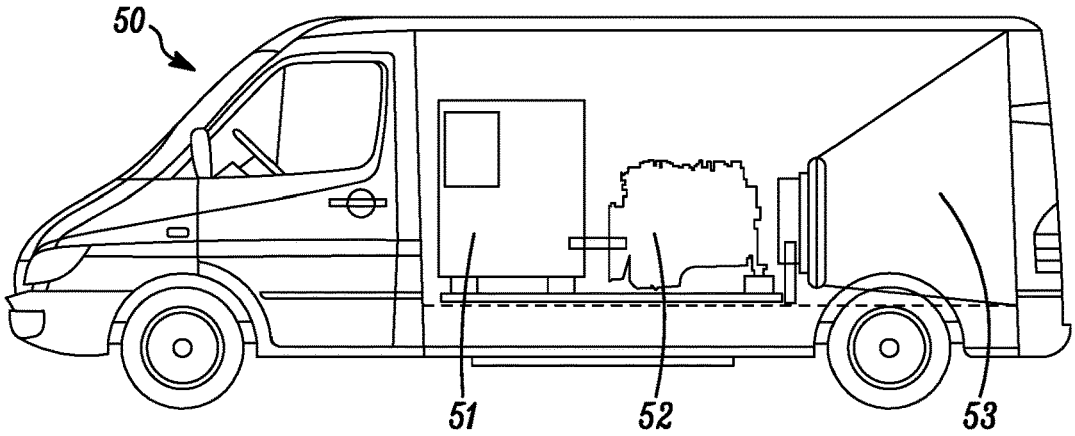
FIG. 13 is a side view of a mobile vehicle for providing power and storage for the current simulation apparatus.

As shown in FIG. 13, the fluid current producing or simulating apparatus assembly 1 can be, for example, a fixed or mobile system which can be easily disassembled and moved or transported by any suitable at least one vehicle 50 and reassembled on site. The vehicle can be a van which can include portable power means in the form of a diesel motor 51 to an electric system (generator) or a hydraulic system 52 i.e. a diesel motor 51 and hydraulic system 52 or electric system along with a forced air cooling system 53 to the motor 51. The hydraulic or electric system 52 can be coupled to the diesel motor 51 to provide adequate power as one option system can also connect to mains power. The receptacle 2 can be transported in the vehicle 50 or in a towed trailer.

The motor 51 and hydraulic pump system 52 are operatively connectable to the current producing apparatus 3 to cause the current producing apparatus 3 to work to draw fluid from around the current producing apparatus 3 and through the first passageways 20 e.g. of receptacles 2 and push the fluid flow back over the middle chamber of each receptacle 2.

In a desirable combination of a middle chamber 30 between outer chambers 31, the middle chambers 30 of each receptacle 2 having at least one enclosed space 19 therein can only be inflated to a certain level because of their relationship to the outer chamber 31.

The side walls 16 which also include first apertures 22 of the inlet and outlet valve system are for receiving fluid e.g. water, to inflate the enclosed space 19 or chambers 30, 31 of all portions of the receptacle 2 except first passageway 20 to a certain shape.

The side walls 16 which include first apertures 21 which are fluidly connected to the first passageway 20 are also positioned to aid in delivering the water back to the current producing apparatus 3 and stop or reduce eddy currents forming on the side walls 16.

Operation

The fluid current producing or simulating apparatus assembly 1 can be located in an optimum position in the pool or body of water as determined by modelling.

The pumping sequences in regards to the inflation and defilation of the individual chambers of the receptacles can be controlled by an inflation and deflation apparatus 22*c* which will be controlled by a computer program that will simulate potential multiple current types. The shapes and positions of the enclosed space 19 or chambers 30, 31 which will provide multiple options of current and wake shapes.

As shown in FIGS. 1-9 various current directions are shown as examples depending on what shape the receptacles 2 are. In FIGS. 2, 4, 5, 6 and 9 (rip shape mode) the receptacle 2 includes an almost flat i.e. uninflated planar middle chamber 30 with the outer chambers 31 having inner facing ramp regions 33 with water current simply moving parallel and over the middle chamber 30 with the sides 9 of the area in a first current direction.

However, in the rapids shape mode of FIGS. 1, 3, 7*b* and 8 there is a second current direction which is produced by having the middle chamber 30 in an alternating pattern with one middle chamber 30 being deeper or higher (inflated) than an adjoining middle chamber 30 of another inflatable receptacle 2, to produce a rapid like current pattern mode. The outer chambers 31 are similar to the outer chambers 31 of FIGS. 2 and 4. These outer chambers 31 have flat top surfaces 17*a* on an outer face and ramped downwardly on an inner edge towards the middle chamber 30 as at ramp region 33.

In FIGS. 2, 4, 5, 6, 9 & 16 (rip shape mode) there is yet a further example of a different flow pattern with receptacles 2 at or near end 8 of the area, having recessed chambers 39 (in the outer chamber 31 and middle chamber 30) to cause the flow to move laterally e.g. towards the sides 9 as shown. For the rip mode type setting (FIGS. 2, 4, 5, 6, 9), initially the diesel motor 51 to hydraulic or electric energy system 52 will be turned on with hydraulic oil pressure or electric power brought up to a desired pressure level, the pumps 42 then are primed and turned on slowly to create a mild state of flow. Again, the outer chambers 31 have an outer flat surface and are ramped on an inner edge towards the middle chamber 30.

FIG. 7*b* shows the middle chamber 30 being flat but raised and still less in height than the ramped regions 33 from the outer chambers 31.

FIG. 7*a* show an entirely flat level top surface across the middle chamber 30 and outer chambers 31.

FIGS. 8 & 9 show the middle chamber 30 being asymmetrical being ramped to a middle slope with outer downward ramps 33 and as in FIG. 9 simply having just a sloped middle chamber 30.

Figure 2:
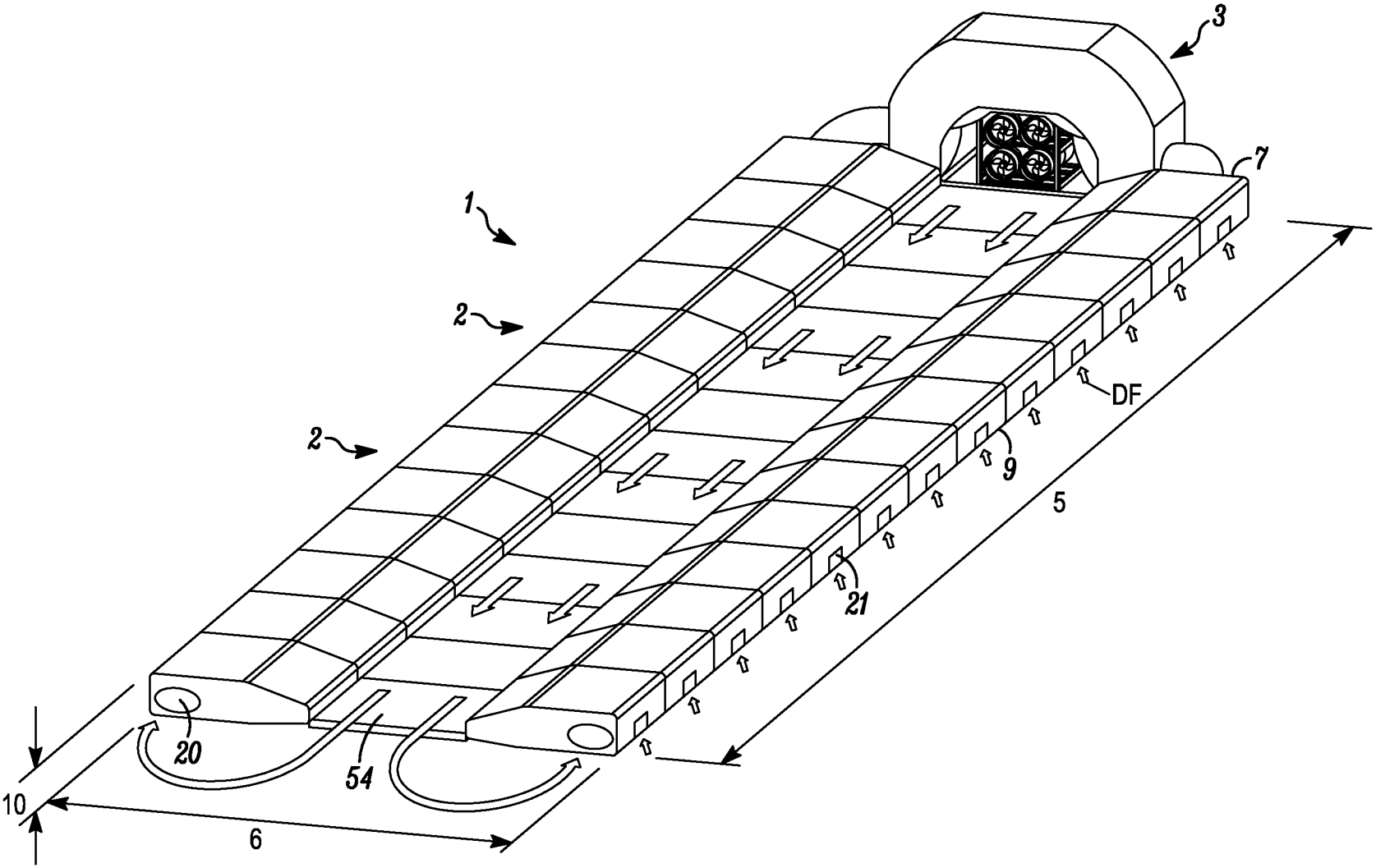
FIG. 2 is an upper perspective view of the fluid current producing or simulating apparatus assembly 1 showing a first current direction when the fluid current producing or simulating apparatus assembly 1 is in use (see FIG. 6). Central or middle receptacles 2 are not inflated to produce a rip current mode.
Figure 3:
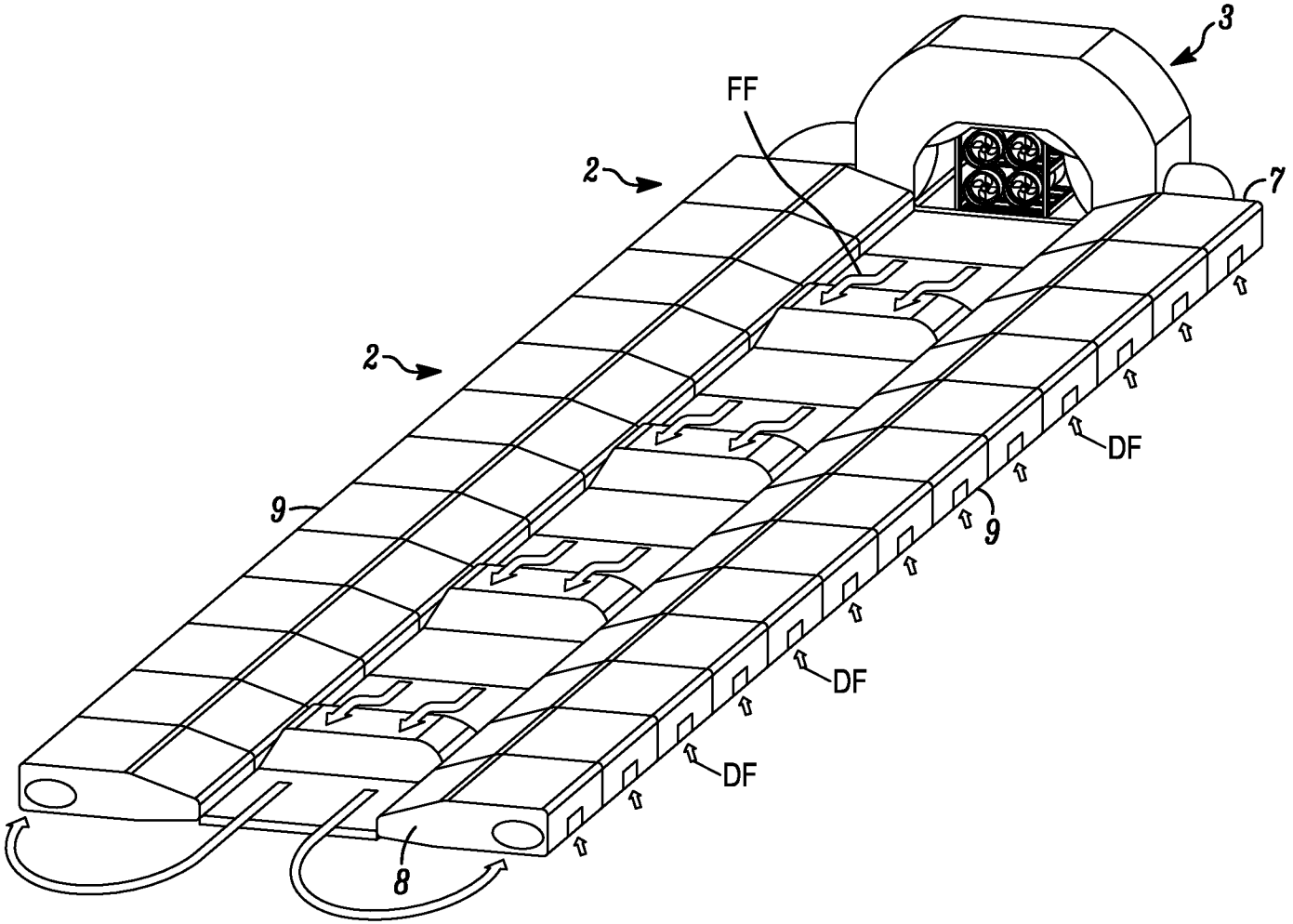
FIG. 3 is an upper perspective view of the apparatus assembly 1 showing a second current direction when the fluid current producing or simulating apparatus assembly 1 is in use—similar to FIG. 1 showing currents for the rapids mode.

As shown in FIGS. 1-3, the middle chamber 30 is less inflated than the outer chambers 31. The outer chambers 31 are formed or inflated having a raised flat level outer surface 17*a* closest to the ends of the fluid current producing or simulating apparatus assembly 1 and ramped downwardly towards the middle chamber 30. The middle chamber 30 can be flat i.e. not inflated as in FIG. 2 or be spaced with alternating raised flat surface and flat with the raised flat regions being still less in height than the flat surface of the outer chambers as in FIGS. 1 & 3. These raised middle chambers 30 can be rounded at their ends when meeting the ramped regions of the outer chambers 31 e.g. see FIGS. 1 & 3.

Once the desired flow of water has started in a circuit, the pump 42 of the current producing apparatus 3 will be bought up to speed all the while a service technician maintains the pump speed and safety procedures. If a rapids mode (e.g. FIGS. 1, 3,7*b*, 8) setting is desired then the fluid current producing or simulating apparatus assembly 1 will be configured to the rapids mode setting which will mean that the middle chamber 30 of each receptacle 2 will have to inflate creating a sort of 'hydraulic jump' or rapids principle forming a rapid when the water flow is forced across it and over an uninflated middle chamber 30 of an adjoining receptacle 2. A lifting system and control panel may be utilized.

There are many outer possibilities for the shapes of the top or outer surfaces 17*a* of the receptacle 2. Such as there being non symmetric shapes or one slope to one side. As shown in some figures, the middle chamber 30 can be peaked as in FIG. 16 or FIG. 4, 5 with simple slopes or ramps or be curved. Any outward shapes can be created depending on control and participant monitoring.

Other modes or shapes include for example a wake boarding or skiing mode (e.g., see FIG. 7*a*) which means that all the receptacles 2 form a floor 300 mm below the water surface. The current producing apparatus 3 directs the water from the pumps 42 up and over the floor which will be designed so that the water is forced up like a wake caused by the back of a boat. The participant will then have a tow rope which will be connected to a motorized transom that will give the participant the freedom to move left-right forward and back and back via controls on the handle.

In order for a pool to continue in use after lessons on the fluid current producing or simulating apparatus assembly 1 have been completed, the apparatus assembly 1 will either stay deflated (water removed) on the pool floor or be detached from each other and from the current producing apparatus 3 to then be removed.

Figure 15:
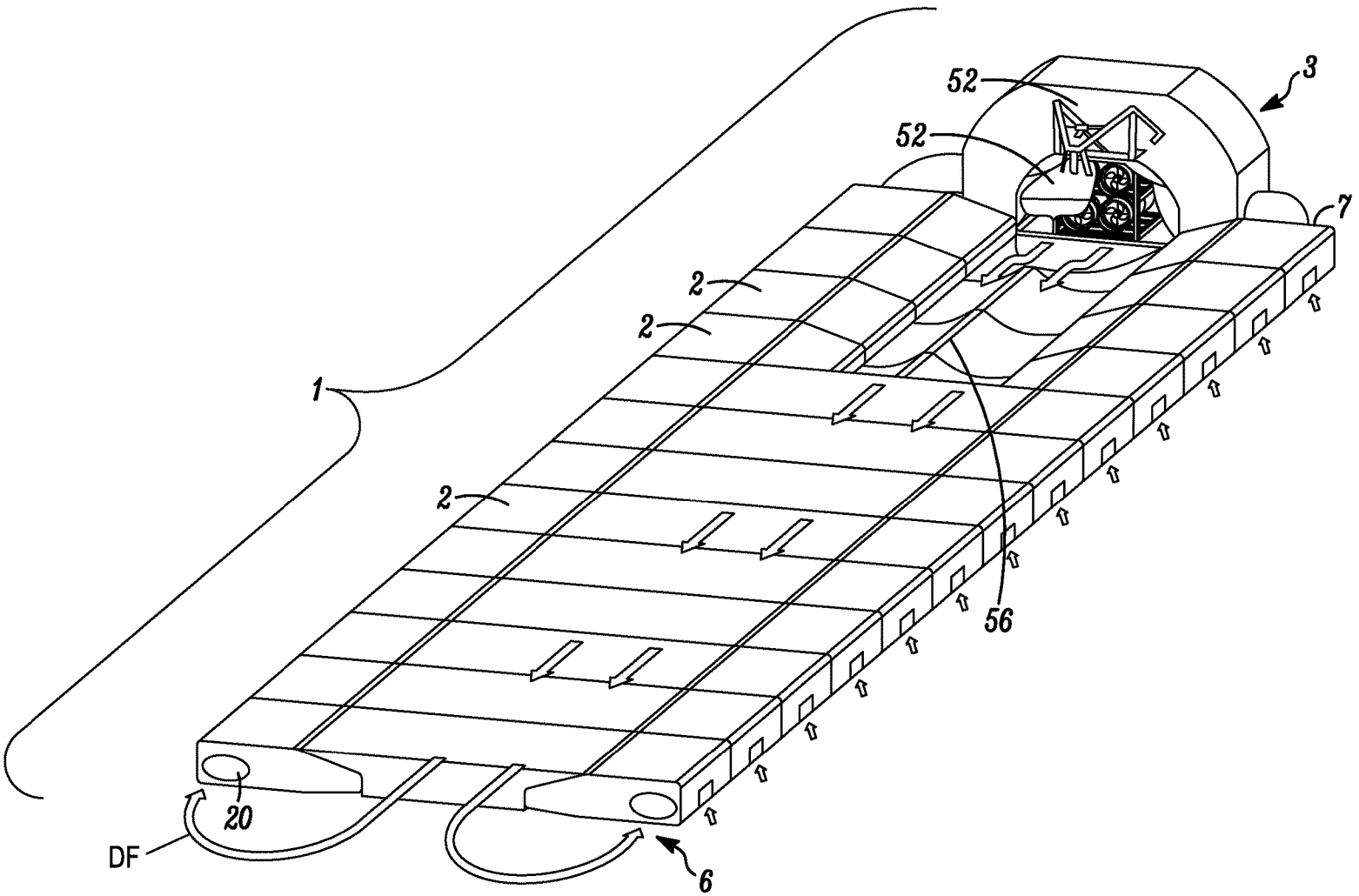
FIG. 15 is schematic upper perspective view of another shape example to produce another wave pattern and different current producing apparatus 3 in a wake mode.

Please reference FIGS. 15 and 16 where the drawing shows the first 3-4 receptacles 2 but is not limited to and can be of a different nature in shape and allow the water to be forced upwards towards the wake press 54 thus creating a wave formation similar to a wake board vessel.

In one aspect the invention resides in a fluid current producing or simulating apparatus assembly 1 for a body of water wherein:

- each receptacle 2 consist of the following items operatively connected together:
  - 3× individual chambers 30, 31
  - 1× middle chamber 30 (of individual enclosed space 19)
  - 2× outer chamber 31 (of individual enclosed space 19)
  - 3× sets of inlets and outlets of second apertures 22
  - 2× passageways 20 e.g. pipe
  - 2× side inlets as first apertures 21 of side wall 16 being inlets to passageway 20

Multi extra enclosed chambers 30, 31 on top of the receptacles 2 is what re-creates multiple extra current patterns—i.e. river and wake mode.

Please note this is the minimum requirement to a receptacle 2 and in this configuration a rip current simulation is created.

Figure 19:
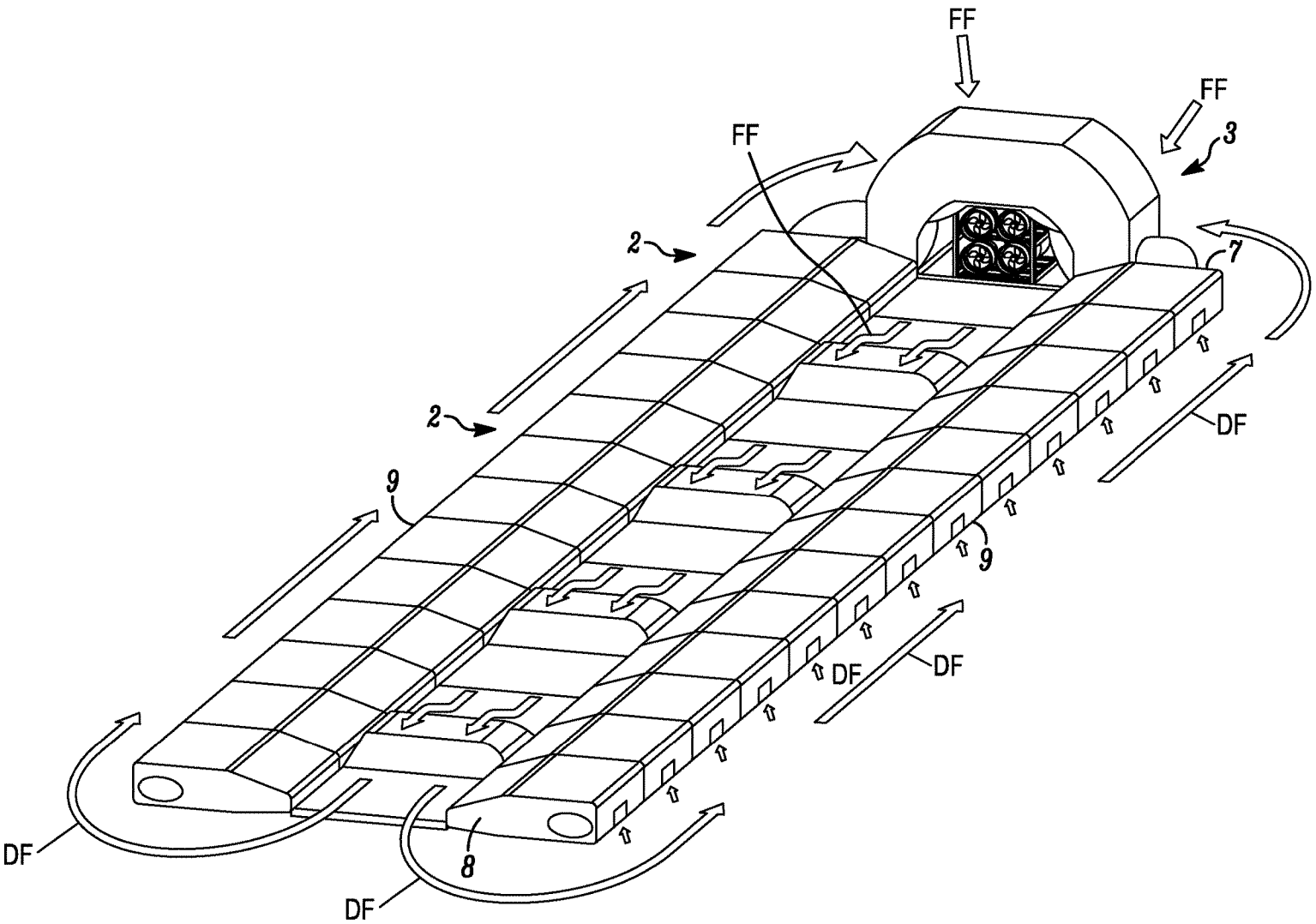
FIG. 19 is a schematic of an assembly with the size of fluid flow being represented by the size of the arrows
Figure 20:
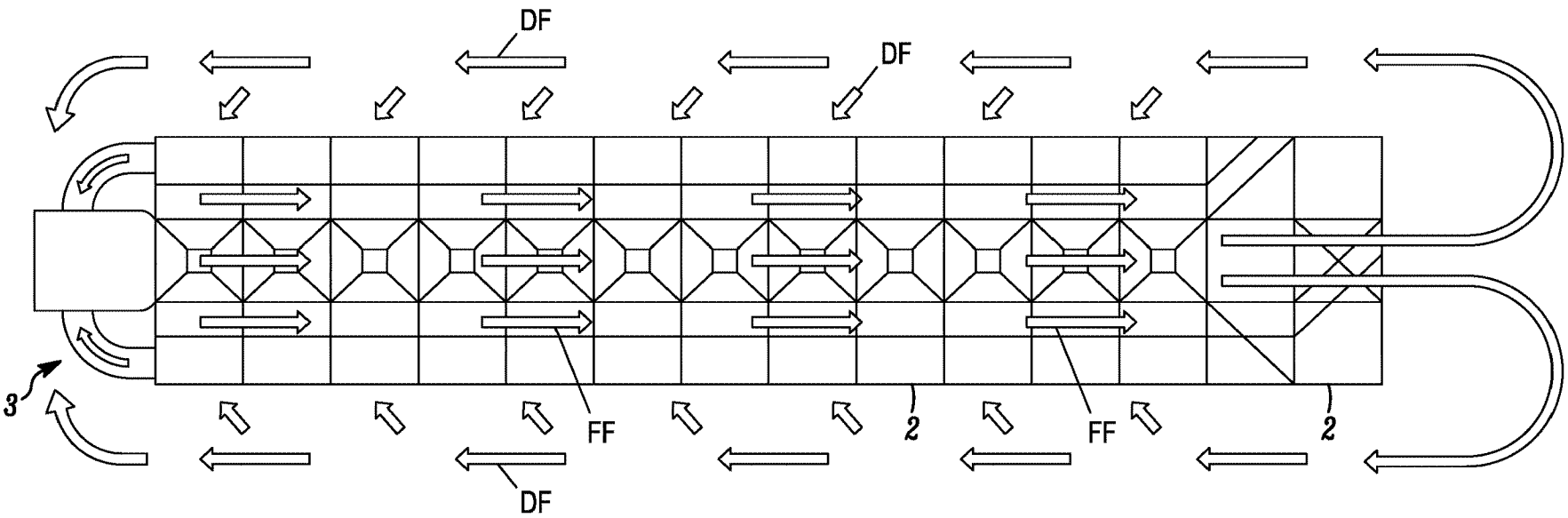
FIG. 20 is a plan view of the assembly depicted in FIG. 4 with the size of fluid flow being represented by the size of the arrows
Figure 21:
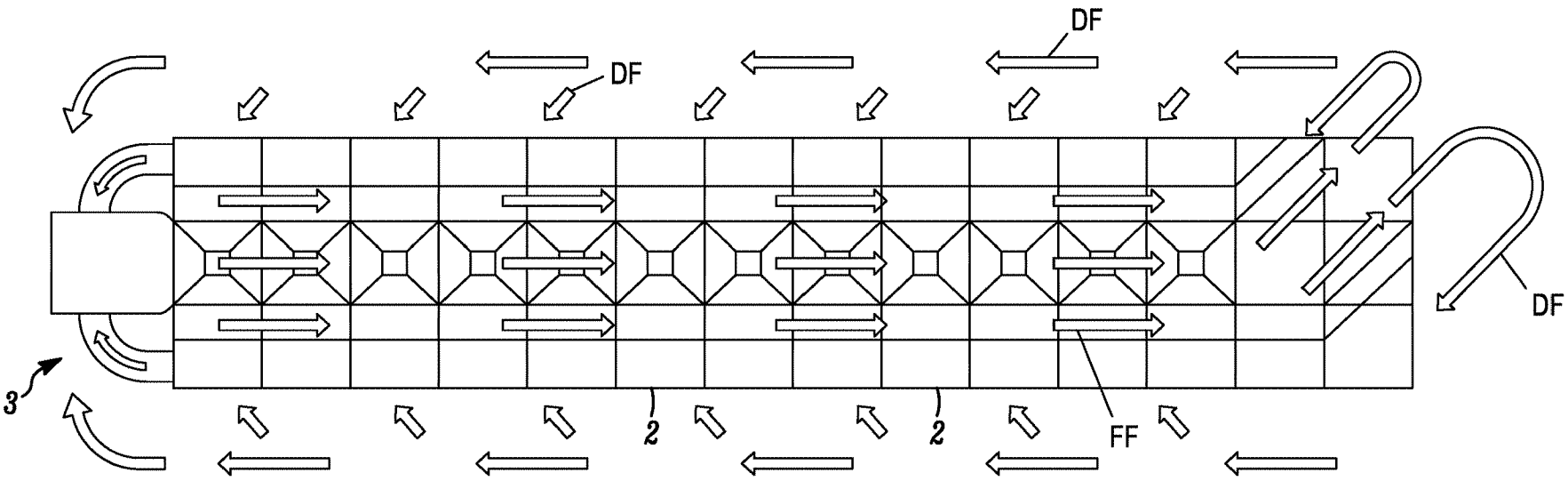
FIG. 21 is a plan view of the assembly depicted in FIG. 4 with the size of fluid flow being represented by the size of the arrows.
Figure 22:
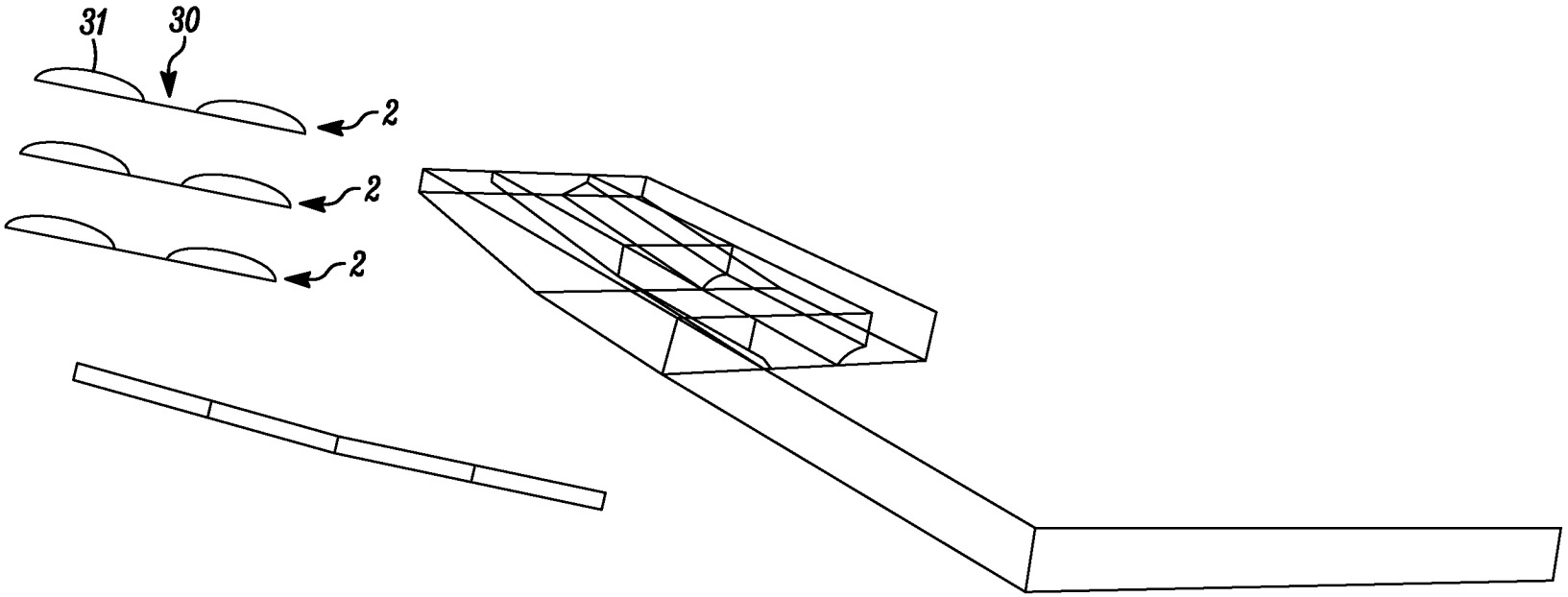
FIG. 22 is a series of cross sections of variations in the shape of a receptacle.
Figure 23:
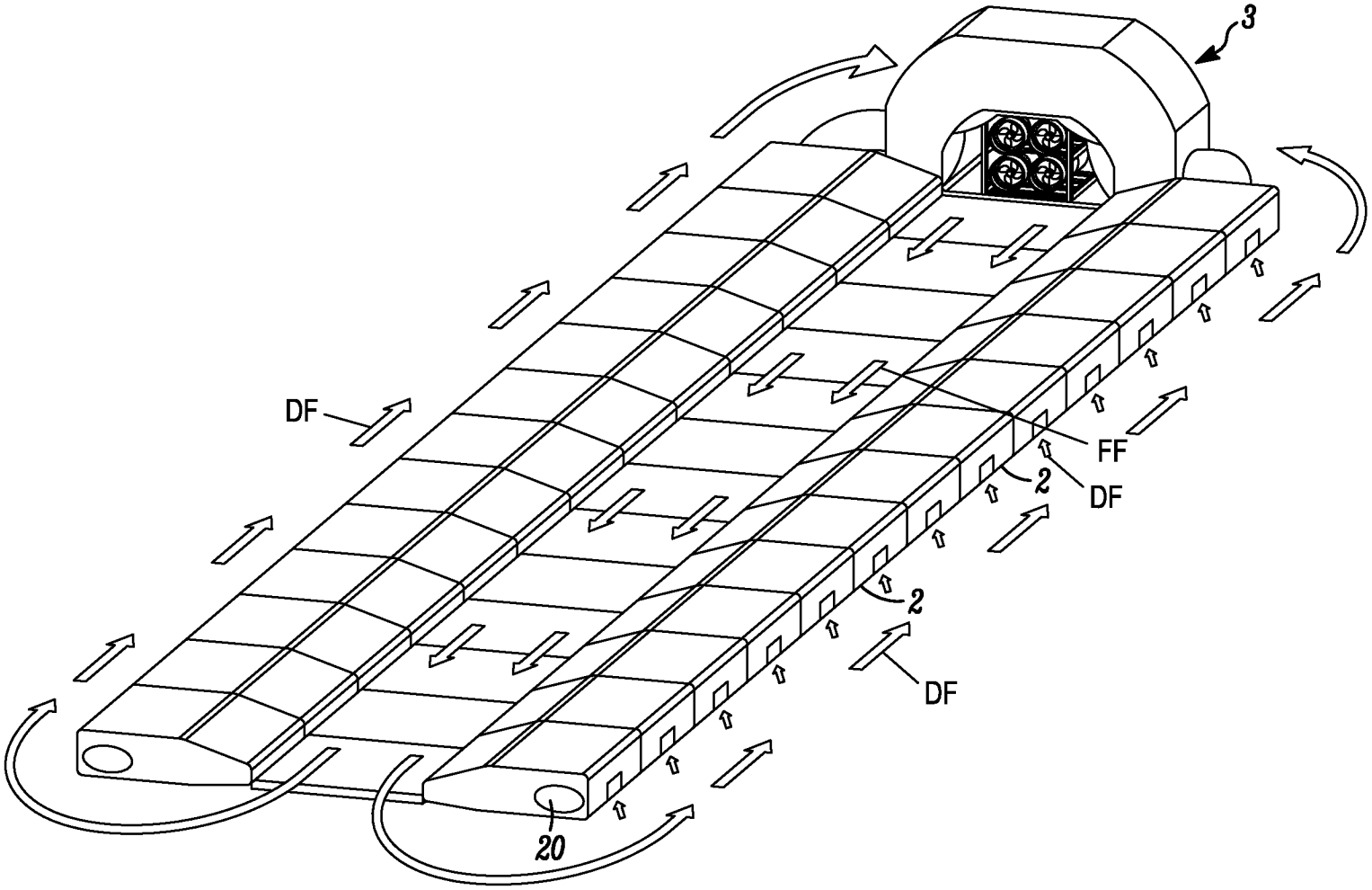
FIG. 23 is a plan view of the assembly depicted in FIG. 2 with the size of fluid flow being represented by the size of the arrows.
Figure 24:
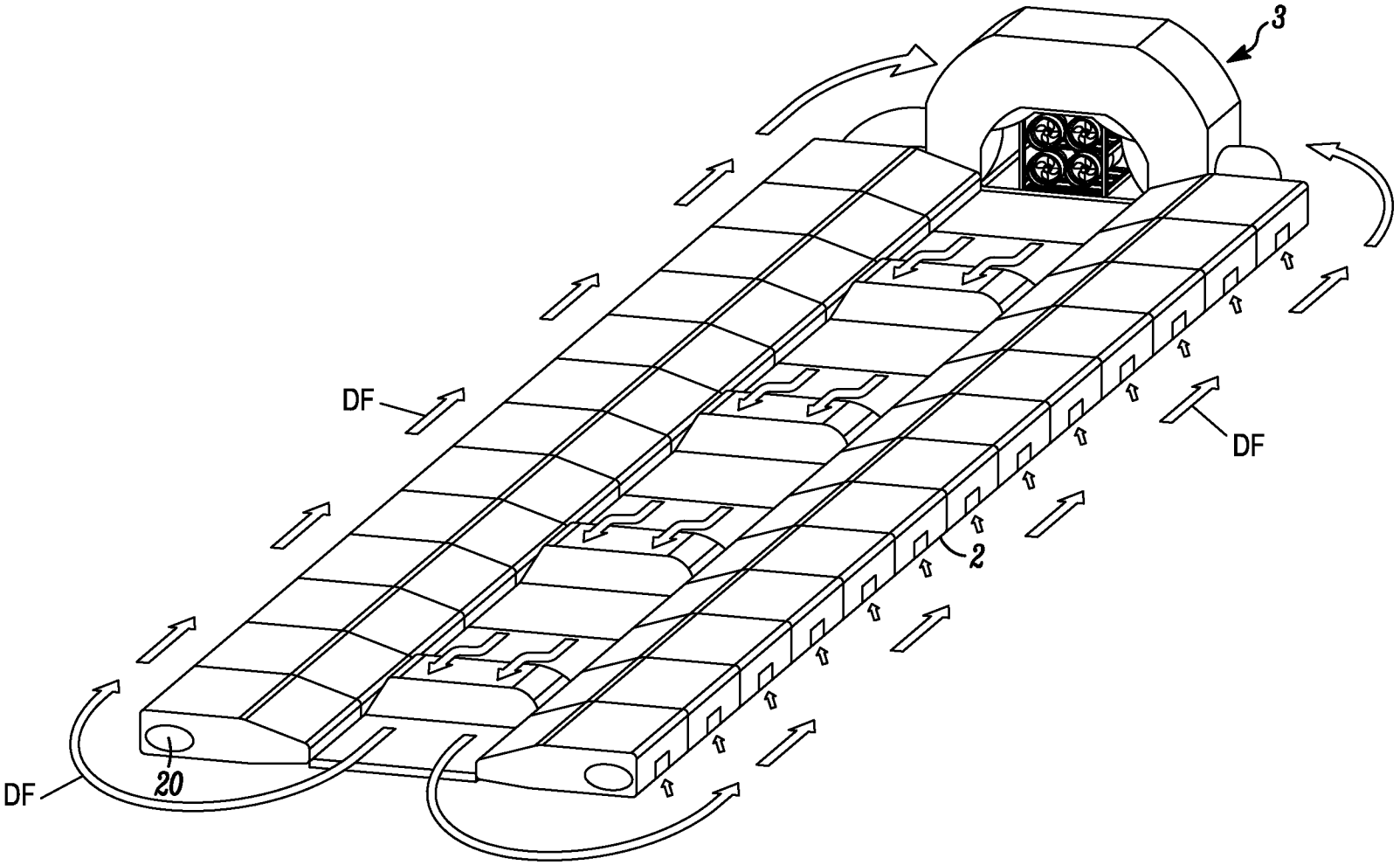
FIG. 24 is a plan view of the assembly depicted in FIG. 3 with the size of fluid flow being represented by the size of the arrows.
Figure 25:
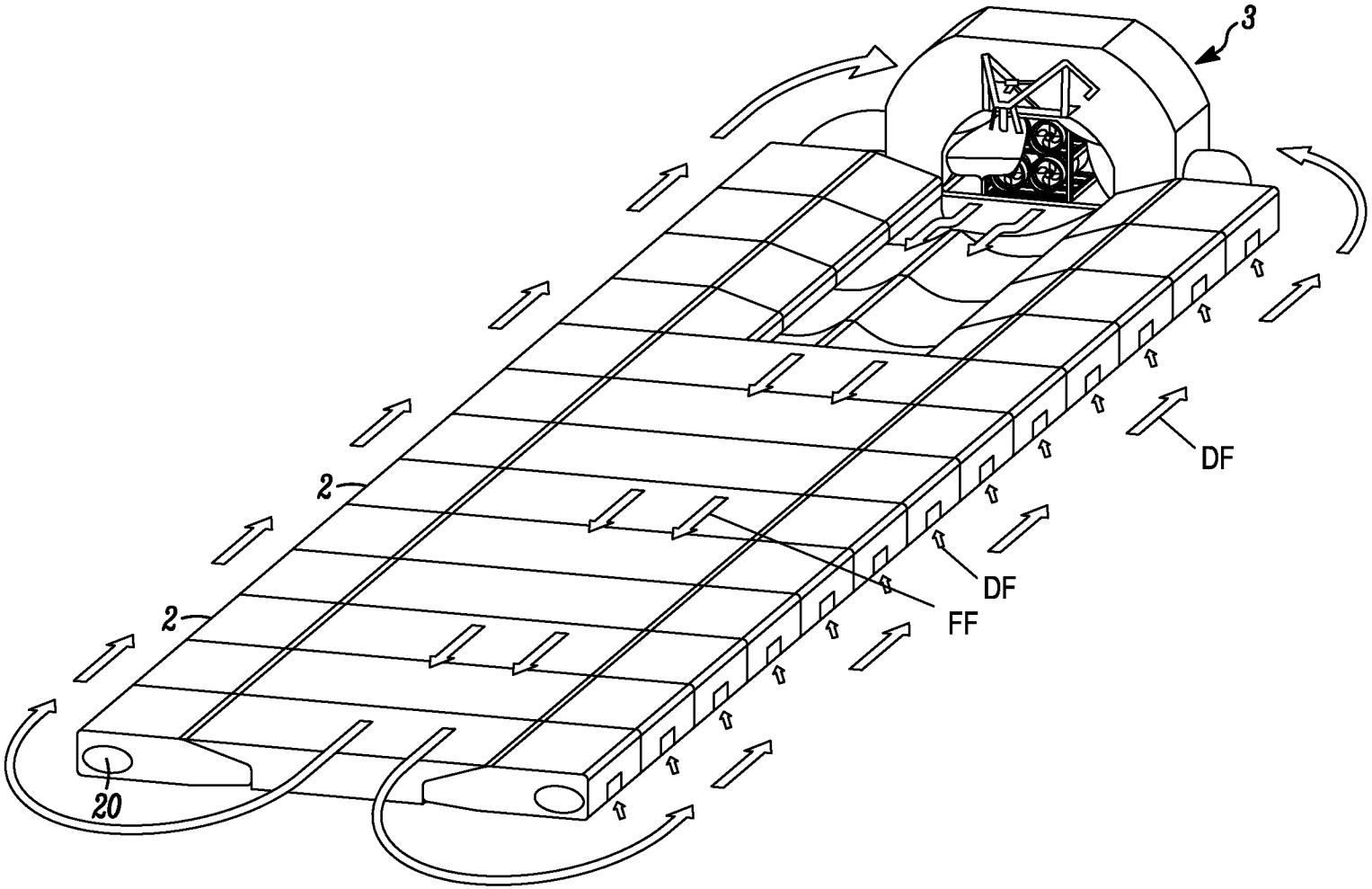
FIG. 25 is a plan view of another variation in the shape of the receptacles (combined version) with the size of fluid flow being represented by the size of the arrows.

As shown in FIG. 19, the water does not only passageway 20 e.g. pipe, rather a majority of the return flow is returned back to the current producing apparatus 3 via a greater share volume of water in the pool and a small return flow circuit is created with some water entering or being drawn through first passageway 20 and through side 9 of the fluid current producing or simulating apparatus assembly 1 having entry ports or first apertures 21 and back to the current producing apparatus 3. A small flow is pushed through first passageway 20 and away from current producing apparatus 3, as compared to the return flow which is a much larger flow being drawn back to the current producing apparatus 3 by travelling over the outer surface 17*a* of the receptacle(s).

First passageway 20 does not inflate and deflate. It is solely a pipe to add the flow back to the current producing apparatus 3.

Side entry ports formed as first apertures 21 eliminate eddy currents forming on side walls 16.

Each chamber 30, 31 is its own internal chamber and no chamber is interconnected but are merely mounted on the base surface 18 of the receptacle 2.

Each enclosed space 19 or chamber 30, 31 has at least a pair of inlets and outlets of the inlet and outlet valve system of second apertures 22 on and through the side of fluid current producing or simulating apparatus assembly 1 in side walls 16 which are fluidly interconnected together to the enclosed space 19 or chambers 30, 31. Other positions for these inlet and outlets i.e. second apertures 22 of the inlet and outlet valve system are also possible.

One example Assembly Method a) Providing a body of a fluid such as water at a desired site location e.g., a pool, lake or sea;
b) Delivering current producing apparatus 3 and number of receptacles 2 to site;
c) Placing at least one receptacle 2 in abutting and floating relationship in the pool to form area with sides 9 and ends 7;
d) Placing current producing apparatus 3 in position at one end 7 of area abutting a first receptacle 2;
e) Connecting first receptacle 2 to current producing apparatus 3—using zip connection;
f) Connecting more receptacles 2 to each other with zip connections and cover with cover flap, to be fluidly interconnected;
g) Connecting inflation and deflation apparatus 22C to a power source connect pressure tubing of piping system 22*a* (see FIG. 14) or by any other suitable means to the entry of second entry aperture 22;
h) Inflating each receptacle 2 with water (through second entry aperture 22) to form the desired receptacle shape forming an outer shape for top 17 for a particular current simulation setting or mode and the first passageways 20 are interconnected whereby the interconnected receptacles 2 then drop to the bottom of the pool;
i) Activating current producing apparatus 3 to draw in water (once the pumps are submerged in the body of water) at least from the sides 9 of the apparatus (i.e. piping installed into side walls 16 of each receptacle 2) in through entry region of first aperture 21 to travel up the first passageway 20 and/or from behind the current producing apparatus 3, and
j) Water is then forced out a front of a housing of the current producing apparatus 3 to go over the outer surfaces 17*a* of the top wall 17 of the middle chamber 30 of the fluidly connected receptacles 2.

Disassembly Method

Suction or pushing air or water in, can be provided via the inflation and deflation apparatus 22*c*

1. A valve body assembly including solenoids (not shown) pumps air into each receptacle 2 through second entry aperture inlet and outlet valve system while drawing out the water from the inflatable receptacles;
2. Receptacles 2 float to surface to then be removed from the pool;
3 Receptacles 2 are then purged of air by vacuum suction via the vacuum pump situated on the inflation and deflation apparatus 22*c;*
4. Receptacles 2 are disconnected using zip connections;
5. Receptacles 2 are packed into vehicle or trailer 50;
6. Current producing apparatus 3 is disconnected from power from vehicle 50 or other source;
7. Current producing apparatus 3 is retrieved and put in vehicle 50.

These steps can be altered without affecting the end result of installing and/or removing the fluid current simulation apparatus 1. For example, placing the current producing apparatus 3 in place in the pool before the receptacles 2. Or for example one can connect the receptacles 2 together before connecting to the current producing apparatus 3.

Optional Advantages a) Easy to use or
b) Modest cost or
c) Relatively safe or
d) Readily portable or
e) Simple to operate or
f) Abel to create rips or
g) Simple installation or
h) Simple manufacture or
i) Does not need extra water or
j) Simple set up and operation or
k) Can be used to reduce drownings or
l) Can be used for training purposes or
m) Can be main powered or be portable or
n) Able to be used with existing pools or
o) Can be used for amusement purposes or
p) Able to create different current or wave conditions or
q) Can optionally have a first passageway 20
r) Any number of chambers per receptacles or
s) Easy to replicate challenging water conditions or
t) Realistic current patterns or modes can be produced or
u) Easy to train people to swim in varying water conditions.
v) Able to be used with any substantially enclosed body of water/fluid
w) Able to interconnect receptacles for fluid travel and/or air inflation Variations Throughout the description of this specification, the word "comprise" and variations of that word such as "comprising" and "comprises", are not intended to exclude other additives, components, integers or steps.

The fluid current producing or simulating apparatus of the present invention can be used on any body of water which enables the assembly to work which can include an enclose body of water, or semi enclosed. The term "enclosed" can mean providing sides and/or ends to any body of water such as for example fixed or moving walls or floating walls or baffles etc. The walls need not be continuous but be enough to allow the fluid current producing or simulating apparatus assembly 1 of the present invention to work adequately to produce suitable or useful currents for training and/or enjoyment.

The number of receptacles 2 will vary depending on what area is desired to be covered to produce the desired current pattern. The size and shaped of receptacle 2 will also determine what type of current or mode is required and so will vary accordingly. In another variation, instead of a plurality of receptacles 2 there can be just one inflatable cover the whole area. When referring to 'inflatable' equally this word can mean 'inflatable' and/or 'deflatable' are both included in its general meaning.

The shape orientation, number and position of the first passageway 20 can be varied to suit particular current pattern requirements and cost. First passageway 20 is shown as being oval shaped but equally any cross-sectional shape is possible e.g. circular. More than one first passageway 20 of the same or different cross sections and longitudinal shape is also possible. The receptacles 2 can be of identical shape or they can be mixed depending on the type of current required. The degree of inflation for each receptacle 2 can be varied with regard to the individual middle and outer portions and also between each abutting or adjoining receptacle 2 to produce different modes or current simulation patterns. Any number and arrangement of chambers or volumes and methods of inflating or deflating either singularly separately or together, for each receptacle 2 or more than one receptacle 2 is possible.

The top wall of the receptacles 2 can be of similar shape or be different or form an overall slope from end 7 to end 8 of the area, as well as the sloping from side wall 16 to side wall 16 of each receptacle 2. Extra baffles or ribs can be placed within the enclosed space of a receptacle 2 and also protruding ribs or depressions can also be applied to the outside of each receptacle 2.

The first passageway(s) 20 are shown as being fluidly interconnected but equally the second passageways as formed as enclosed space 19 or inflatable chambers 30, 31 that are as shown as being fluidly separate, can in another option be fluidly interconnected as well with each other across each end of each chamber of each receptacle 2 for all interconnected receptacles 2. The direction of flow of the fluid can be firstly forced away from the current producing apparatus 3 to be drawing distally at the far end of the first passageway 20 way or receipt from the current producing apparatus 3, to draw back towards the current producing apparatus 3 or vice versa. The shapes of the first passageways 20, enclosed space 19, and chambers 30, 31 outer surfaces 17*a*, apertures or ports 21, 22 can be varied in size shape and positioning to suit requirements. For example, first passageway 20 is in the shape of a pipe or tube.

Figure 4:
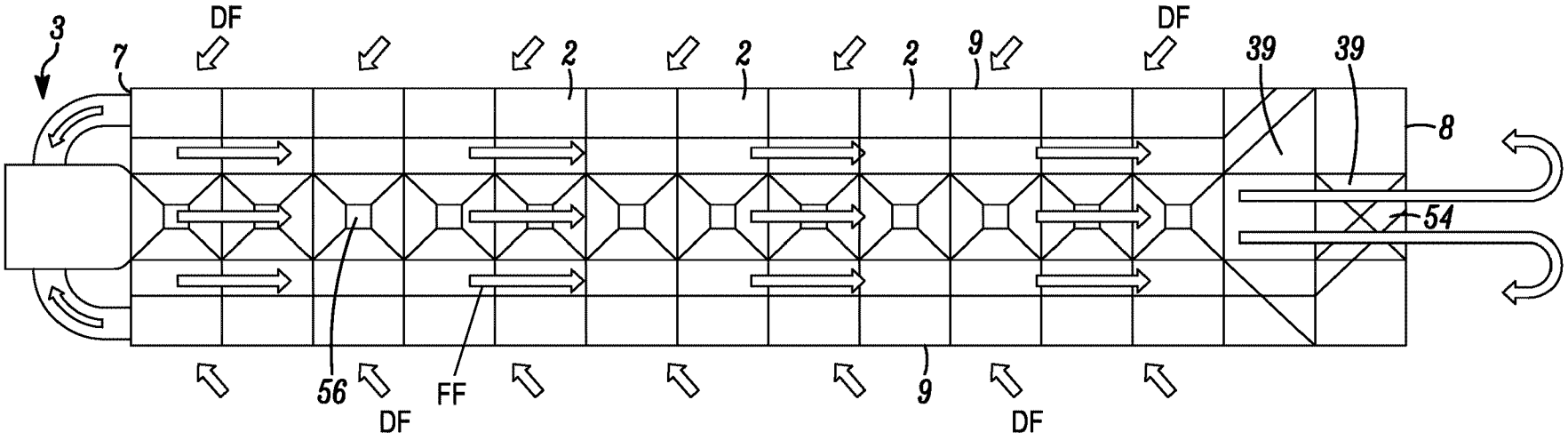
FIG. 4 is a top plan view of the fluid current producing or simulating apparatus assembly 1 of FIG. 2 e.g. is a rip current mode with a straight flow.
Figure 5:
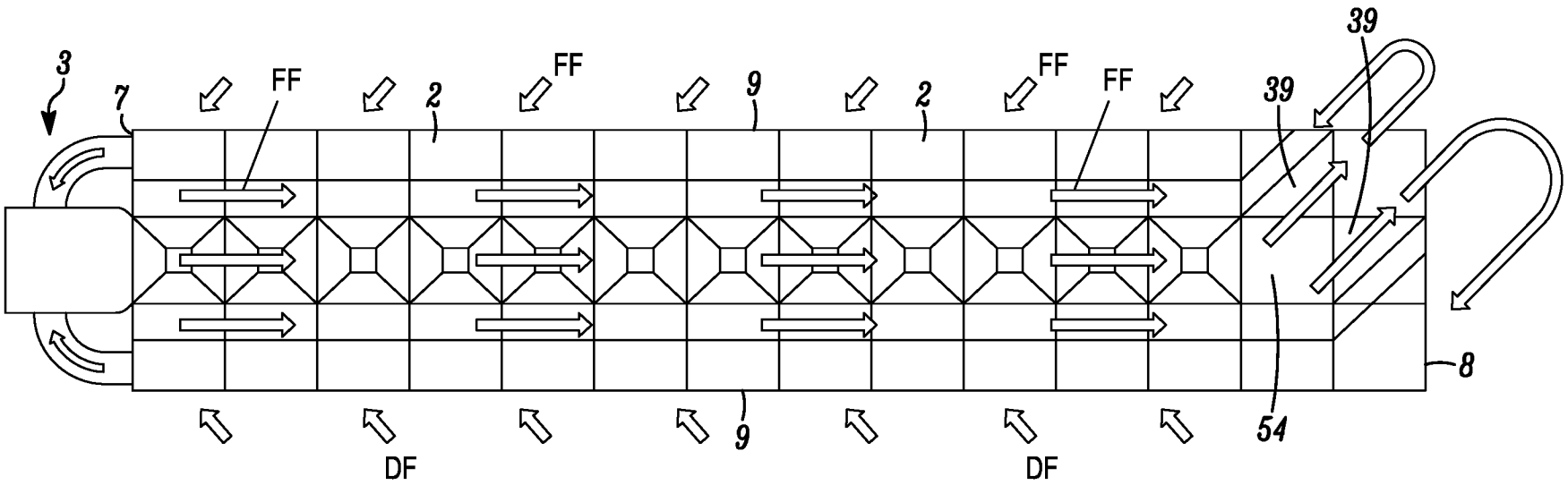
FIG. 5 is a top plan view of the fluid current producing or simulating apparatus assembly 1 with a third current direction using an end deflecting portion by inflating an end outer chamber of at least the last inflatable receptacle 2—this is a rip current mode but with a current turn at the end.

FIGS. 4 and 5 are plan views which appear to show a different shape for the middle chamber 30 i.e. with a central square and angled lines radiating out from the corner of the square—this is just the folds or creases formed in the middle chamber 30 that enable middle chamber 30 to inflate to a particular shape—equally, other folds, baffles or patterns etc are possible depending on what inflated shape is required or current mode is wanted. The same applies to the outer chamber 31 which can also be formed of different shapes with different folds or patterns. With a number of multi chambers attached above middle chamber 30 and also has a piping system 22*a* composed of pipework 22*b* and an inlet and outlet of second aperture 22, this is also the same for outer chambers 31 and ramp region 33. In yet another example receptacle 2 instead of middle and outer portions, can have just one chamber with at least one fluidly interconnected internal chambers or compartments.

All chambers and compartments will usually be separate to allow for individual controllable inflation and deflation.

The receptacles 2 can be fabricated from a hypalon material though any other materials and combination of a malleable or flexible material are also possible. One combination example can include from the top, a coloured hypalon layer followed by a neoprene layer, followed by an adhesive primer layer or coating, followed by high density (tenacity) textile layer, followed by two neoprene layers. There can be multiple malleable options.

In terms of power options instead of the diesel motor, one can use any other suitable means such as for example an electrical power system being mains connected, solar power or use batteries. The current producing apparatus 3 can operate electrically or portably with any suitable pumps 42 that can be used with and in water, such as hydraulic or electric pumps The at least one pump 42 in the current producing apparatus 3 and inflation and deflation apparatus 22*c* for pumping fluid relative to second aperture 22 in side wall 16 to inflate the enclosed space 19 or chambers 30, 31 which will also be controlled by a computer as well as having shrouds in front of the water stream exiting the pump in order to steer the water in a correct or specified direction.

As shown in FIGS. 11, 15-17 there is another current producing apparatus 3 with a variation in the shape of the receptacle 2. Receptacle 2 is labelled similarly to the receptacle of the other figures. In this example, the middle chamber 30 is shaped as central peak 56 which is designed to cause another wave pattern type. Current producing apparatus 3 depicted in FIGS. 11, 15-17 has similar components to the other previously discussed current producing apparatus 3 but with a front cover shroud 58 (including a support frame and cover) to help deflect the fluid being forced over the top or outer surface 17*a* of the receptacles 2. Please refer to wake press 54 and ramp region 33 as disclosed in this specification e FIG. 16.

As shown in FIG. 16 the enclosed space 19 or chambers 30, 31 of the at least one receptacle 2 includes a fourth outer shape (see FIG. 16) which is also termed a wake board mode. This shape includes a peaked inflated middle chamber 30 between outer level chambers 31. There are ramped regions 33 between the middle chambers 30 and outer chambers 31 and the middle regions are formed having a curved surface ramped upwardly to a central peak. The ramped regions 33 of the outer chambers 31 ends in a lowest point, greater than the lowest point of the central or middle chamber 30.

Please note that even though the drawings do not show the shroud around the pump housing to be a mesh material in nature, the water is drawn in from all sides except the front facing the receptacles 2 where the water is forced out.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

The various embodiments described above include a number of different features, and it will be apparent to one skilled in the art that they may be combined in combinations other than those specifically described, in order to achieve the object of the invention, and without departing from the spirit and scope of the present invention. All such modifications and variations as would be apparent to persons skilled in the art fall within the broad scope and ambit of the invention.

It will also be understood that where a product, method or process as herein described or claimed and that is sold incomplete, as individual components, or as a "kit of parts", that such exploitation will fall within the ambit of the invention.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process. The terms "including and having" or "having and including", as used herein, are defined as comprising (i.e., open language).

For purposes of the description hereinafter, the terms "upper", "up", "lower", "down", "right", "left", "vertical", "horizontal", "top", "bottom", "lateral", "longitudinal", "side", "front", "rear" and derivatives thereof shall relate to the invention as it is oriented in the drawing figures. However, it is to be understood that the invention may assume various alternative variations, except where expressly specified to the contrary.

It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

What I claim is:

1. A fluid current producing apparatus assembly for use in a body of water, the fluid current producing apparatus assembly comprising:

at least one receptacle;

a fluid current producing apparatus; and an inflation and deflation apparatus, wherein the at least one receptacle includes a receptacle body, the receptacle body forming at least one first enclosed space, the at least one first enclosed space containing at least one independently inflatable and deflatable chamber for receipt of a fluid therein to inflate at least a portion of the at least one receptacle, the receptacle body having an inner surface and an outer surface located outside the at least one first enclosed space such that controllable inflation and deflation occurs to modify a shape and flow pattern produced by the at least one receptacle, and wherein the receptacle body of the at least one receptacle has side walls, opposed end walls, a top wall, the top wall having a top wall outer surface and a base surface, the base surface having a base an outer surface, wherein the at least one receptacle also includes at least one second enclosed space is configured to allow inflation or deflation therein, inflation or deflation caused by the inflation and deflation apparatus, wherein the at least one receptacle is fluidly connected to the fluid current producing apparatus and wherein the fluid current producing apparatus is configured to operate by drawing in fluid from the body of water and forcing a first subportion of fluid drawn from the body of water back over the top wall outer surface of the at least one receptacle in an inflated state, the first subportion of fluid moving in a circuit in a direction away from the fluid current producing apparatus;

wherein inflation by the inflation and deflation apparatus of the at least one second enclosed space by a second portion of the fluid introduced into the at least one independently inflatable and deflatable chamber defined in the at least one receptacle forces at least one region of the at least one receptacle to be inflated and formed of a particular outward upper shape thereby, when the portion of fluid drawn from the body of water is forced by the fluid current producing apparatus over the outside surface of the at least one receptacle from a front of the fluid current producing apparatus assembly away from the fluid current producing apparatus assembly, and wherein the portion of water drawn from the body of water is drawn in predominantly from sides of the at least one receptacle back to the fluid current producing apparatus in a circuit of flow, thereby creating different wave patterns for the first subportion of fluid flowing over the outside surface of the at least one receptacle in an inflated state; and wherein the at least one receptacle includes at least one first passageway for a flow of the portion of fluid therethrough, the at least one receptacle extending from an end wall to an opposed end wall and at least one second passageway, separate from the at least one first passageway, wherein the at least one second passageway provides an extra facility to allow water to be pulled away from the side walls to reduce eddy currents forming on the side walls of the at least one receptacle wherein there is no inflation and deflation in the at least one first passageway, and only minor flow will be induced in and through the at least one first passageway as compared to the flow outside of the fluid current producing apparatus assembly and back to the fluid current producing apparatus.

2. The fluid current producing apparatus assembly of claim 1, wherein the fluid current producing apparatus assembly comprises at least two receptacles, wherein each receptacle has a receptacle body, the receptacle body of each receptacle includes at least one top wall and a closable entry to allow constant inflation or deflation of the at least one independently inflatable and deflatable chamber defined in the at least one first enclosed space defined in the at least one receptacle via the inflation and deflation apparatus which will change a fluid flow pattern over the outer surface of the at least one top wall of the receptacle.

3. The fluid current producing apparatus assembly of claim 2, wherein each of the at least two receptacles includes a bag connecting system having one part of a zip fastening system located at an edge between the top wall and end walls of the associated receptacle, and wherein each of the at least two receptacles has at least one cover flap inlet whereby each adjoining receptacle includes part of the zip fastening system to work together to fasten one first receptacle to an adjoining second receptacle whereby each of the first receptacle and adjoining second receptacle includes a track and one of each receptacle includes a slider so that when two receptacles are abutting or adjoining they can be zipped together to form a continuous channel wherein an inlet accessing the first passageway is located in side walls to minimize formation of eddy currents on the first passageway.

4. The fluid current producing apparatus assembly of claim 2, wherein the at least two receptacles each are configured to include at least one middle region and at least two outer regions interconnected to allow inflation and/or deflation therethrough when the respective at least two receptacles are interconnected when the fluid current producing apparatus is in an operative position, wherein the at least two outer regions are disposed on opposite sides of the at least one middle region, and wherein the at least one middle region and at least two outer regions of each of the at least two receptacles are fluidly separated from each other.

5. The fluid current producing apparatus assembly of claim 4, wherein, in the use position when inflated, an upper portion of the at least one middle region and an upper portion of the at least two outer regions are shaped to cause different wave patterns over at least the outer surface of the top wall of the respective receptacles, and wherein the shape of the at least one middle region significantly affects the wave pattern.

6. The fluid current producing apparatus assembly of claim 4, wherein the at least one second enclosed space of each receptacle including the at least one middle region has a first outer shape configured to produce a rip current mode, and wherein each receptacle includes a planar uninflated middle portion between two blocked shaped outer inflated portions defining inner sloped top surfaces.

7. The fluid current producing apparatus assembly of claim 4, wherein each receptacle includes a shape configured to produce a wake board mode wherein the at least one middle region is fully inflated and has a top surface level with top walls of the respective outer regions when inflated.

8. The fluid current producing apparatus assembly of claim 2, wherein each receptacle is configured with a rapids mode middle shape, the rapids mode middle shape including a block-shaped inflated middle region, the block-shaped inflated middle region having a size larger than an associated non-inflated planar region of the middle region but less in height than inflated height of outer inflated regions, with the outer inflated regions defining an inner sloped top surface, and wherein the middle region has a level top surface and the outer regions have level top surfaces wherein height of the level top surface of the middle region is less than height of the level top surfaces of the outer regions which are ramped there between.

9. The fluid current producing apparatus assembly of claim 1, wherein the at least one receptacle is fabricated from a malleable or flexible material that facilitates pressurization upon introduction of fluid that causes at least a portion of the at least one receptacle to be inflated.

10. The fluid current producing apparatus assembly of claim 1, having at least two receptacles wherein each of the at least two receptacles is configured with a wake board mode middle region having a wake board middle shape, the wake board middle shape including at least a peaked inflated middle region located between outer level regions, wherein the outer level regions have ramped regions connected to the wake board mode middle region, wherein the wake board mode middle region is curved ramped to the peaked inflated middle region.

11. The fluid current producing apparatus assembly of claim 1, wherein the fluid current producing apparatus includes a housing, at least one pump associated with the housing and meshed guarded intake piping, the intake piping fluidly interconnectable between the fluid current producing apparatus and the at least one first passageway of the at least one receptacle to enable the at least one pump to draw in aqueous fluid, which is then forced or pumped out, over the top of the at least one receptacle.

12. The fluid current producing apparatus assembly of claim 11 further comprising a power supply operatively connected to the at least one pump and to the inflation and deflation apparatus.

13. The fluid current producing apparatus assembly of claim 1, wherein the fluid current producing apparatus assembly includes at least two receptacles, each of the at least two receptacles forming an inflatable bag system, wherein each of the at least two receptacles are individually inflated via an inlet and outlet valve system and connected by a piping system to the first and/or second enclosed space associated therewith for at least a portion of each receptacle, and wherein the piping system includes interconnected pipework, and the inflation and deflation apparatus.

14. The fluid current producing apparatus assembly of claim 1, wherein the fluid current producing apparatus assembly includes at least two receptacles wherein each of the at least two receptacles has an inlet valve system and an outlet valve system and a piping system attached to the inlet valve system and the outlet valve system, the piping system communicating with the first and/or second enclosed space defined in the respective receptacle and to the inflation and deflation apparatus whereby each of the at least two receptacles is inflated and deflated by pumping fluid drawn from the body of water.

15. The fluid current producing apparatus assembly of claim 14, wherein a pumping sequence is utilized relative to inflation and deflation of the at least one first and/or second enclosed space present in each of the at least two of the receptacles, wherein inflation and deflation of the at least one fist and/or second enclosed space present in each of the at least two receptacles is controlled by the inflation and deflation apparatus, and wherein the inflation and deflation apparatus is controlled by a computer program that will simulate potential multiple current types.

16. The fluid current producing apparatus assembly of claim 15, wherein the inflation and deflation apparatus includes at least one pump, an electronic controlled solenoid, and a pump and the piping system, the piping system being operatively connected to an aperture of the inlet and outlet valve system of the side walls of the at least two receptacles.

17. A fluid current producing apparatus assembly for use in a body of water, the fluid current producing apparatus assembly comprising:

at least two receptacles, wherein each of the at least two receptacles has an inflated state and a deflated state, each of the at least two receptacles having a receptacle body having side walls, opposed end walls, a top wall, a base, an inwardly oriented surface and an outwardly oriented surface, the receptacle body forming at least one first enclosed space containing at least one first inflatable and deflatable chamber and at least one second enclosed space containing at least one second inflatable and deflatable chamber, wherein the at least one first inflatable and deflatable chamber is independent of the at least one second inflatable and deflatable chamber, the at least two receptacles removably positionable in the body of water;

a fluid current producing apparatus fluidly connected to the at least two receptacles, the fluid current producing apparatus, configured to draw water from the body of water and force a first portion of the water drawn from the body of water over the top wall of at least one of the at least two receptacles, when the receptacle is in the inflated state, the water moving in a circuit direction away from the fluid current producing apparatus;

an inflation and deflation apparatus, the inflation and deflation apparatus fluidly connected to the at least two receptacles, wherein the inflation and deflation apparatus is configured to inflate and deflate the at least two receptacles by inflation and deflation of at least the first enclosed space, the second enclosed space or both;

wherein inflation by the inflation and deflation apparatus of the first enclosed space present in the at least two receptacles is accomplished by introduction of water drawn from the body of water and introduced into at least one independently inflatable chamber defined in the at least one first enclosed space modifies a shape and flow pattern produced by the associated receptacle;

wherein the at least two receptacles each include at least one first passageway configured to accommodate water flowing therethrough and at least one second passageway separate from the at least one first passageway, wherein the at least one second passageway provides an extra facility to allow water to be pulled away from the side walls to reduce eddy currents forming on the side walls of the at least two receptacles, wherein there is no inflation and deflation in the at least one first passageway, and only minor flow will be induced in and through the at least one first passageway as compared to the flow outside of the fluid current producing apparatus assembly and back to the fluid current producing apparatus.

18. The fluid current producing apparatus assembly of claim 17, wherein the at least two receptacles are fabricated from a malleable or flexible material that facilitates pressurization upon introduction of fluid that causes at least a portion of the at least two receptacles to be inflated.

19. The fluid current producing apparatus assembly of claim 18, wherein each of the at least two receptacles includes a bag connecting system having one part of a zip fastening system located at an edge between the top wall and end walls of the associated receptacle, and wherein each of the at least two receptacles has at least one cover flap inlet whereby each adjoining receptacle includes part of the zip fastening system to work together to fasten one first receptacle to an adjoining second receptacle whereby each of the first receptacle and adjoining second receptacle includes a track and one of each receptacle includes a slider so that when two receptacles are abutting or adjoining they can be zipped together to form a continuous channel wherein an inlet accessing the first passageway is located in side walls to minimize formation of eddy currents on the first passageway.

* * * * *